US011852391B2

(12) United States Patent
Christensen et al.

(10) Patent No.: US 11,852,391 B2
(45) Date of Patent: Dec. 26, 2023

(54) SYSTEMS AND METHODS FOR PRESSURE CONTROL IN A CO2 REFRIGERATION SYSTEM

(71) Applicant: Hill Phoenix, Inc., Conyers, GA (US)

(72) Inventors: Kim G. Christensen, Aarhus V (DK); Jeffrey Newel, Snellville, GA (US); John D. Bittner, Conyers, GA (US)

(73) Assignee: Hill Phoenix, Inc., Conyers, GA (US)

( * ) Notice: Subject to any disclaimer, the term of this patent is extended or adjusted under 35 U.S.C. 154(b) by 58 days.

(21) Appl. No.: 17/340,947

(22) Filed: Jun. 7, 2021

(65) Prior Publication Data

US 2021/0364210 A1 Nov. 25, 2021

Related U.S. Application Data

(63) Continuation of application No. 14/787,666, filed as application No. PCT/US2014/036131 on Apr. 30, 2014, now Pat. No. 11,029,068.

(Continued)

(51) Int. Cl.
*F25B 49/02* (2006.01)
*F25B 9/00* (2006.01)

(Continued)

(52) U.S. Cl.
CPC ..... *F25B 49/022* (2013.01); *F25B 9/008* (2013.01); *F25B 1/10* (2013.01); *F25B 5/02* (2013.01);

(Continued)

(58) Field of Classification Search
CPC ..... F25B 2500/07; F25B 2600/2523; F25B 2600/2501; F25B 2600/25; F25B 9/008; B60H 1/3217; B60H 1/3216
See application file for complete search history.

(56) References Cited

U.S. PATENT DOCUMENTS 4,270,363 A 6/1981 Maring et al.
4,589,263 A 5/1986 Dicarlo et al.

(Continued)

FOREIGN PATENT DOCUMENTS

EP 1789732 5/2007
EP 2078178 7/2009

(Continued)

OTHER PUBLICATIONS

EP Office Action in European Appln. No. 18156889.0, dated Nov. 18, 2021, 13 pages.

(Continued)

*Primary Examiner* — Nelson J Nieves
*Assistant Examiner* — Meraj A Shaikh
(74) *Attorney, Agent, or Firm* — Fish & Richardson P.C.

(57) ABSTRACT

Systems and methods for controlling pressure in a $CO_2$ refrigeration system are provided. The pressure control system includes a pressure sensor, a gas bypass valve, a parallel compressor, and a controller. The pressure sensor is configured to measure a pressure within a receiving tank of the $CO_2$ refrigeration system. The gas bypass valve is fluidly connected with an outlet of the receiving tank and arranged in series with a compressor of the $CO_2$ refrigeration system. The parallel compressor is fluidly connected with the outlet of the receiving tank and arranged in parallel with both the gas bypass valve and the compressor of the $CO_2$ refrigeration system. The controller is configured to receive a pressure measurement from the pressure sensor and operate both the gas bypass valve and the parallel compressor, in response to the pressure measurement, to control the pressure within the receiving tank.

21 Claims, 11 Drawing Sheets

Related U.S. Application Data

(60) Provisional application No. 61/819,253, filed on May 3, 2013.

(51) Int. Cl.
*F25B 40/00* (2006.01)
*F25B 5/02* (2006.01)
*F25B 1/10* (2006.01)

(52) U.S. Cl.
CPC ..... *F25B 40/00* (2013.01); *F25B 2309/061* (2013.01); *F25B 2400/075* (2013.01); *F25B 2400/22* (2013.01); *F25B 2400/23* (2013.01); *F25B 2500/07* (2013.01); *F25B 2600/2509* (2013.01); *F25B 2700/13* (2013.01); *F25B 2700/21163* (2013.01)

(56) References Cited

U.S. PATENT DOCUMENTS 5,425,246 A 6/1995 Bessler
5,539,382 A 7/1996 Duff et al.
5,735,134 A 4/1998 Liu et al.
6,385,980 B1 5/2002 Sienel
6,415,611 B1 7/2002 Acharya et al.
6,418,735 B1 7/2002 Sienel
7,065,979 B2 6/2006 Arshansky et al.
7,114,343 B2 10/2006 Kates
7,406,837 B2 8/2008 Nemoto et al.
7,599,759 B2 10/2009 Zugibe et al.
7,752,854 B2 7/2010 Singh et al.
7,913,506 B2 3/2011 Bittner et al.
8,011,192 B2 9/2011 Gupte
8,511,103 B2 8/2013 Welch
8,631,666 B2 1/2014 Hinde et al.
8,756,947 B2 6/2014 Chen et al.
8,966,934 B2 3/2015 Christensen
9,121,631 B2 9/2015 Cho et al.
9,151,521 B2 10/2015 Bittner
9,335,079 B2 5/2016 Huff et al.
9,353,980 B2 5/2016 Ignatiev
9,395,112 B2 7/2016 Prins
9,470,435 B2 10/2016 Hinde et al.
9,541,311 B2 1/2017 Hinde et al.
9,625,183 B2 4/2017 Wallace et al.
9,657,977 B2 5/2017 Hinde et al.
9,664,424 B2 5/2017 Hinde et al.
9,689,590 B2 6/2017 Christensen
11,029,068 B2 6/2021 Christensen et al.
2003/0182961 A1 10/2003 Nishida et al.
2005/0011221 A1* 1/2005 Hirota ..... F04F 5/461 62/500
2005/0178150 A1* 8/2005 Oshitani ..... F25B 5/00 62/500
2005/0217278 A1 10/2005 Mongia et al.
2005/0268625 A1 12/2005 Sienel et al.
2007/0199337 A1 8/2007 Otake et al.
2008/0006044 A1 1/2008 Tan
2008/0098754 A1* 5/2008 Sommer ..... F25B 41/00 62/115
2008/0196420 A1* 8/2008 Gernemann ..... F25B 9/008 62/509
2008/0264077 A1 10/2008 Heinbokel
2010/0000245 A1 1/2010 Kasahara et al.
2010/0199707 A1 8/2010 Pearson
2010/0263393 A1* 10/2010 Chen ..... F25B 49/022 62/434
2011/0036110 A1 2/2011 Fujimoto et al.
2011/0041527 A1* 2/2011 Jakobsen ..... F25B 9/008 62/468
2011/0162397 A1* 7/2011 Huff ..... F25B 1/10 62/132
2011/0314843 A1 12/2011 Heinbokel et al.
2012/0000237 A1 1/2012 Yamada et al.
2012/0011866 A1 1/2012 Scarcella et al.
2012/0055182 A1 3/2012 Dube
2012/0073319 A1 3/2012 Dube
2012/0192579 A1 8/2012 Huff et al.
2012/0247148 A1 10/2012 Dube
2013/0036757 A1* 2/2013 Okaichi ..... F25B 1/10 62/228.3
2013/0125569 A1* 5/2013 Verma ..... F25B 1/06 62/115
2013/0233009 A1 9/2013 Dube
2013/0298593 A1 11/2013 Christensen
2014/0007603 A1 1/2014 Dube
2014/0116075 A1 5/2014 Prins
2014/0157811 A1 6/2014 Shimazu et al.
2014/0208785 A1 7/2014 Wallace et al.
2014/0291411 A1 10/2014 Tamaki et al.
2014/0326018 A1* 11/2014 Ignatiev ..... F25B 49/02 62/527
2014/0352343 A1* 12/2014 Hinde ..... F25B 7/00 62/277
2015/0052927 A1 2/2015 Yang et al.
2015/0059373 A1 3/2015 Maiello et al.
2015/0128628 A1 5/2015 Kawagoe et al.
2015/0176866 A1* 6/2015 Takayama ..... F25B 49/02 62/140
2015/0345835 A1 12/2015 Martin et al.
2015/0354882 A1 12/2015 Dube
2016/0102901 A1 4/2016 Christensen et al.
2016/0245575 A1 8/2016 Dube
2017/0363337 A1 12/2017 Swofford et al.
2018/0216851 A1 8/2018 Christensen et al.
2019/0368786 A1 12/2019 Newel et al.
2020/0033039 A1 1/2020 Krishnamoorthy et al.

FOREIGN PATENT DOCUMENTS

EP 2212631 8/2010
EP 1848933 12/2010
EP 2329206 6/2011
EP 2407734 1/2012
GB 2 460 726 12/2009
JP 2004-257694 9/2004
JP 2005024210 1/2005
JP 2011503504 1/2011
KR 10-0858991 5/2021
WO WO 2006087011 8/2006
WO WO 2006091190 8/2006
WO WO 2009086493 7/2009
WO WO 2010045743 4/2010
WO WO 2011066214 6/2011
WO WO 2011071959 6/2011
WO WO 2013169591 11/2013
WO WO 2014068967 5/2014
WO WO 2014179699 11/2014

OTHER PUBLICATIONS

Co2oltec, A world first in technology: Refrigeration with CO2, special print from KK Die Kalte & Klimatechnik, Edition Feb. 2005, 15 pps.
EP European Foreign Search Report in European Appln. No. 18156889.0, dated May 4, 2018, 10 pages.
Extended European Search Report regarding EP Application No. 14791933.6, dated Feb. 2, 2017, 10 pps.
Heat recovery from CO2 based refrigeration systems, Advansor Energisystemer, dated Mar. 26, 2008, 5 pps.
Heos user manual for high efficiency showcase controller, Carel Industries, dated Sep. 24, 2015, 56 pps.
PCT International Preliminary Report on Patentability of PCT Application No. PCT/US2014/036131 (F&L 060507-1546), dated Nov. 12, 2015, 9 pages.
PCT International Search Report and Written Opinion of International Appln. No. PCT/US2014/036131), dated Aug. 21, 2014, 10 pages.

* cited by examiner

SYSTEMS AND METHODS FOR PRESSURE CONTROL IN A CO2 REFRIGERATION SYSTEM

CROSS-REFERENCE TO RELATED APPLICATIONS

This application is a continuation of, and claims priority under 35 U.S.C. § 120 to, U.S. patent application Ser. No. 14/787,666, filed on Oct. 28, 2015, which is a U.S. national stage under 35 U.S.C. § 371 of International PCT Application Number PCT/US2014/036131, filed on Apr. 30, 2014, which claims priority to and the benefit of U.S. Provisional Patent Application No. 61/819,253, filed on May 3, 2013, all of which are hereby incorporated by reference in their entirety.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this Application and is not admitted to be prior art by inclusion in this section.

The present description relates generally to a refrigeration system primarily using carbon dioxide (i.e., $CO_2$) as a refrigerant. The present description relates more particularly to systems and methods for controlling pressure in a $CO_2$ refrigeration system using a gas bypass valve and a parallel compressor.

Refrigeration systems are often used to provide cooling to temperature controlled display devices (e.g. cases, merchandisers, etc.) in supermarkets and other similar facilities. Vapor compression refrigeration systems are a type of refrigeration system which provide such cooling by circulating a fluid refrigerant (e.g., a liquid and/or vapor) through a thermodynamic vapor compression cycle. In a vapor compression cycle, the refrigerant is typically (1) compressed to a high temperature/pressure state (e.g., by a compressor of the refrigeration system), (2) cooled/condensed to a lower temperature state (e.g., in a gas cooler or condenser which absorbs heat from the refrigerant), (3) expanded to a lower pressure (e.g., through an expansion valve), and (4) evaporated to provide cooling by absorbing heat into the refrigerant.

Some refrigeration systems provide a mechanism for controlling the pressure of the refrigerant as it is circulated and/or stored within the refrigeration system. For example, a pressure-relieving valve can be used to vent or release excess refrigerant vapor if the pressure within the refrigeration system (or a component thereof) exceeds a threshold pressure value. However, typical pressure control mechanisms can be inefficient and often result in wasted energy or suboptimal system performance.

SUMMARY

One implementation of the present disclosure is a system for controlling pressure in a $CO_2$ refrigeration system. The system for controlling pressure includes a pressure sensor, a gas bypass valve, a parallel compressor, and a controller. The pressure sensor is configured to measure a pressure within a receiving tank of the $CO_2$ refrigeration system. The gas bypass valve is fluidly connected with an outlet of the receiving tank and arranged in series with a compressor of the $CO_2$ refrigeration system. The parallel compressor is fluidly connected with the outlet of the receiving tank and arranged in parallel with both the gas bypass valve and the compressor of the $CO_2$ refrigeration system. The controller is configured to receive a pressure measurement from the pressure sensor and operate both the gas bypass valve and the parallel compressor, in response to the pressure measurement, to control the pressure within the receiving tank.

In some embodiments, the controller comprises an extensive control module configured to receive an indication of a $CO_2$ refrigerant flow rate through the gas bypass valve. The extensive control module is further configured to receive the pressure measurement from the pressure sensor and operate both the gas bypass valve and the parallel compressor in response to both the indication of the $CO_2$ refrigerant flow rate and the pressure measurement. In some embodiments, the extensive control module is further configured to compare the indication of the $CO_2$ refrigerant flow rate with a threshold value, the threshold value indicating a threshold flow rate through the gas bypass valve, and activate the parallel compressor in response to the indication of the $CO_2$ refrigerant flow rate exceeding the threshold value. In some embodiments, the indication of the $CO_2$ refrigerant flow rate is one of: a position of the gas bypass valve, a volume flow rate of the $CO_2$ refrigerant through the gas bypass valve, and a mass flow rate of the $CO_2$ refrigerant through the gas bypass valve.

In some embodiments, the controller comprises an intensive control module configured to receive an indication of a $CO_2$ refrigerant temperature. The intensive control module is further configured to receive the pressure measurement from the pressure sensor and operate both the gas bypass valve and the parallel compressor in response to both the indication of the $CO_2$ refrigerant temperature and the pressure measurement. In some embodiments, the indication of the $CO_2$ refrigerant temperature indicates a temperature of $CO_2$ refrigerant at an outlet of a gas cooler/condenser of the $CO_2$ refrigeration system. In some embodiments, the intensive control module is further configured to compare the indication of the $CO_2$ refrigerant temperature with a threshold value, the threshold value indicating a threshold temperature for the $CO_2$ refrigerant, and activate the parallel compressor in response to the indication of the $CO_2$ refrigerant temperature exceeding the threshold value.

In some embodiments, the controller is further configured to, determine a pressure within the receiving tank based on the measurement from the pressure sensor and compare the pressure within the receiving tank with both a first threshold pressure and a second threshold pressure. In some embodiments, the second threshold pressure is higher than the first threshold pressure. In some embodiments, the controller is configured to control the pressure within the receiving tank using only the gas bypass valve in response to a determination that the pressure within the receiving tank is between the first threshold pressure and the second threshold pressure. In some embodiments, the controller is configured to control the pressure within the receiving tank using both the gas bypass valve and the parallel compressor in response to a determination that the pressure within the receiving tank exceeds the second threshold pressure.

In some embodiments, the controller is further configured to adjust the first threshold pressure and the second threshold pressure in response to a determination that the pressure within the receiving tank exceeds the second threshold pressure. In some embodiments, adjusting the first threshold pressure involves increasing the first threshold pressure to a first adjusted threshold pressure value. In some embodiments, adjusting the second threshold pressure involves decreasing the second threshold pressure to a second adjusted threshold pressure value lower than the first adjusted threshold pressure value.

In some embodiments, after adjusting the first threshold pressure and the second threshold pressure, the controller is configured to control the pressure within the receiving tank using only the parallel compressor in response to a determination that the pressure within the receiving tank is between the first adjusted threshold pressure and the second adjusted threshold pressure. In some embodiments, the controller is further configured to deactivate the parallel compressor in response to a determination that the pressure within the receiving tank is less than the second adjusted threshold pressure.

In some embodiments, the controller is further configured to reset the first threshold pressure and the second threshold pressure to non-adjusted threshold pressure values in response to a determination that the pressure within the receiving tank is less than the second adjusted threshold pressure.

Another implementation of the present disclosure is a method for controlling pressure in a $CO_2$ refrigeration system. The method includes receiving, at a controller, a measurement indicating a pressure within a receiving tank of the $CO_2$ refrigeration system, operating a gas bypass valve arranged in series with a compressor of the $CO_2$ refrigeration system, and operating a parallel compressor arranged in parallel with both the gas bypass valve and the compressor of the $CO_2$ refrigeration system. The gas bypass valve and parallel compressor are both fluidly connected with an outlet of the receiving tank. The gas bypass valve and parallel compressor are operated in response to the measurement from the pressure sensor to control the pressure within the receiving tank.

In some embodiments, the method includes receiving an indication of a $CO_2$ refrigerant flow rate through the gas bypass valve and operating both the gas bypass valve and the parallel compressor in response to both the indication of the $CO_2$ refrigerant flow rate and the measurement from the pressure sensor. In some embodiments, the method includes comparing the indication of the $CO_2$ refrigerant flow rate with a threshold value, the threshold value indicating a threshold flow rate through the gas bypass valve. The parallel compressor may be activated in response to the indication of the $CO_2$ refrigerant flow rate exceeding the threshold value. In some embodiments, the indication of the $CO_2$ refrigerant flow rate is one of: a position of the gas bypass valve, a volume flow rate of the $CO_2$ refrigerant through the gas bypass valve, and a mass flow rate of the $CO_2$ refrigerant through the gas bypass valve.

In some embodiments, the method includes receiving an indication of a $CO_2$ refrigerant temperature an outlet of a gas cooler/condenser of the $CO_2$ refrigeration system and operating both the gas bypass valve and the parallel compressor in response to both the indication of the $CO_2$ refrigerant temperature and the measurement from the pressure sensor. In some embodiments, the method includes comparing the indication of the $CO_2$ refrigerant temperature with a threshold value, the threshold value indicating a threshold temperature for the $CO_2$ refrigerant, and activating the parallel compressor in response to the indication of the $CO_2$ refrigerant temperature exceeding the threshold value.

In some embodiments, the method includes determining a pressure within the receiving tank using the measurement from the sensor and comparing the pressure within the receiving tank with both a first threshold pressure and second threshold pressure. The second threshold pressure may be higher than the first threshold pressure. In some embodiments, the method includes controlling the pressure within the receiving tank using only the gas bypass valve in response to a determination that the pressure within the receiving tank is between the first threshold pressure and the second threshold pressure. In some embodiments, the method includes controlling the pressure within the receiving tank using both the gas bypass valve and the parallel compressor in response to a determination that the pressure within the receiving tank exceeds the second threshold pressure.

In some embodiments, the method includes adjusting the first threshold pressure and the second threshold pressure in response to a determination that the pressure within the receiving tank exceeds the second threshold pressure. In some embodiments, adjusting the first threshold pressure involves increasing the first threshold pressure to a first adjusted threshold pressure value. In some embodiments, adjusting the second threshold pressure involves decreasing the second threshold pressure to a second adjusted threshold pressure value lower than the first adjusted threshold pressure value.

In some embodiments, the method includes controlling the pressure within the receiving tank using only the parallel compressor in response to a determination that the pressure within the receiving tank is between the first adjusted threshold pressure and the second adjusted threshold pressure. In some embodiments, the method includes deactivating the parallel compressor in response to a determination that the pressure within the receiving tank is less than the second adjusted threshold pressure.

In some embodiments, the method includes resetting the first threshold pressure and the second threshold pressure to previous non-adjusted threshold pressure values in response to a determination that the pressure within the receiving tank is less than the second adjusted threshold pressure.

Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Figure 1:
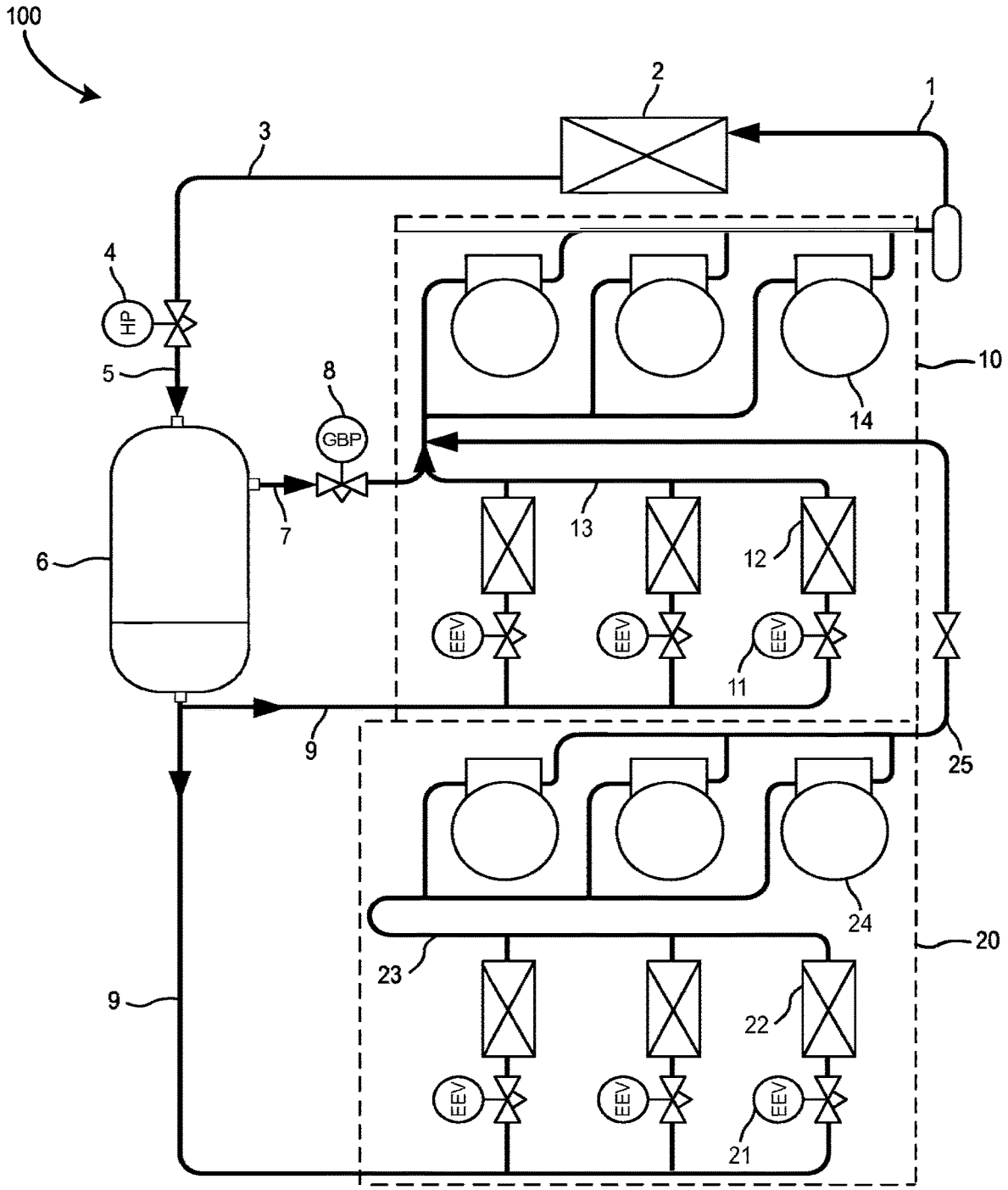
FIG. 1 is a schematic representation of a $CO_2$ refrigeration system having a $CO_2$ refrigeration circuit, a receiving tank for containing a mixture of liquid and vapor $CO_2$ refrigerant, and a gas bypass valve fluidly connected with the receiving tank for controlling a pressure within the receiving tank, according to an exemplary embodiment.

Referring generally to the FIGURES, a $CO_2$ refrigeration system and components thereof are shown, according to various exemplary embodiments. The $CO_2$ refrigeration system may be a vapor compression refrigeration system which uses primarily carbon dioxide (i.e., $CO_2$) as a refrigerant. In some implementations, the $CO_2$ refrigeration system may be used to provide cooling for temperature controlled display devices in a supermarket or other similar facility.

In some embodiments, the $CO_2$ refrigeration system includes a receiving tank (e.g., a flash tank, a refrigerant reservoir, etc.) containing a mixture of $CO_2$ liquid and $CO_2$ vapor, a gas bypass valve, and a parallel compressor. The gas bypass valve may be arranged in series with one or more compressors of the $CO_2$ refrigeration system. The gas bypass valve provides a mechanism for controlling the $CO_2$ refrigerant pressure within the receiving tank by venting excess $CO_2$ vapor to the suction side of the $CO_2$ refrigeration system compressors. The parallel compressor may be arranged in parallel with both the gas bypass valve and with other compressors of the $CO_2$ refrigeration system. The parallel compressor provides an alternative or supplemental means for controlling the pressure within the receiving tank.

Advantageously, the $CO_2$ refrigeration system includes a controller for monitoring and controlling the pressure, temperature, and/or flow of the $CO_2$ refrigerant throughout the $CO_2$ refrigeration system. The controller can operate both the gas bypass valve and the parallel compressor (e.g., according to the various control processes described herein) to efficiently regulate the pressure of the $CO_2$ refrigerant within the receiving tank. Additionally, the controller can interface with other instrumentation associated with the $CO_2$ refrigeration system (e.g., measurement devices, timing devices, pressure sensors, temperature sensors, etc.) and provide appropriate control signals to a variety of operable components of the $CO_2$ refrigeration system (e.g., compressors, valves, power supplies, flow diverters, etc.) to regulate the pressure, temperature, and/or flow at other locations within the $CO_2$ refrigeration system. Advantageously, the controller may be used to facilitate efficient operation of the $CO_2$ refrigeration system, reduce energy consumption, and improve system performance.

In some embodiments, the $CO_2$ refrigeration system may include one or more flexible air conditioning modules (i.e., "AC modules"). The AC modules may be used for integrating air conditioning loads (i.e., "AC loads") or other loads associated with cooling a facility in which the $CO_2$ refrigeration system is implemented. The AC modules may be desirable when the facility is located in warmer climates, or locations having daily or seasonal temperature variations that make air conditioning desirable within the facility. The flexible AC modules are "flexible" in the sense that they may have any of a wide variety of capacities by varying the size, capacity, and number of heat exchangers and/or compressors provided within the AC modules. Advantageously, the AC modules may enhance or increase the efficiency of the systems (e.g., the $CO_2$ refrigeration system, the AC system, the combined system, etc.) by the synergistic effects of combining the source of cooling for both systems in a parallel compression arrangement.

Before discussing further details of the $CO_2$ refrigeration system and/or the components thereof, it should be noted that references to "front," "back," "rear," "upward," "downward," "inner," "outer," "right," and "left" in this description are merely used to identify the various elements as they are oriented in the FIGURES. These terms are not meant to limit the element which they describe, as the various elements may be oriented differently in various applications.

It should further be noted that for purposes of this disclosure, the term "coupled" means the joining of two members directly or indirectly to one another. Such joining may be stationary in nature or moveable in nature and/or such joining may allow for the flow of fluids, transmission of forces, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Referring now to FIG. 1, a $CO_2$ refrigeration system 100 is shown according to an exemplary embodiment. $CO_2$ refrigeration system 100 may be a vapor compression refrigeration system which uses primarily carbon dioxide as a refrigerant. $CO_2$ refrigeration system 100 and is shown to include a system of pipes, conduits, or other fluid channels (e.g., fluid conduits 1, 3, 5, 7, and 9) for transporting the carbon dioxide between various thermodynamic components of the refrigeration system. The thermodynamic components of $CO_2$ refrigeration system 100 are shown to include a gas cooler/condenser 2, a high pressure valve 4, a receiving tank 6, a gas bypass valve 8, a medium-temperature ("MT") system portion 10, and a low-temperature ("LT") system portion 20.

Gas cooler/condenser 2 may be a heat exchanger or other similar device for removing heat from the $CO_2$ refrigerant. Gas cooler/condenser 2 is shown receiving $CO_2$ vapor from fluid conduit 1. In some embodiments, the $CO_2$ vapor in fluid conduit 1 may have a pressure within a range from approximately 45 bar to approximately 100 bar (i.e., about 640 psig to about 1420 psig), depending on ambient temperature and other operating conditions. In some embodiments, gas cooler/condenser 2 may partially or fully condense $CO_2$ vapor into liquid $CO_2$ (e.g., if system operation is in a subcritical region). The condensation process may result in fully saturated $CO_2$ liquid or a liquid-vapor mixture (e.g., having a thermodynamic quality between 0 and 1). In other embodiments, gas cooler/condenser 2 may cool the $CO_2$ vapor (e.g., by removing superheat) without condensing the $CO_2$ vapor into $CO_2$ liquid (e.g., if system operation is in a supercritical region). In some embodiments, the cooling/condensation process is an isobaric process. Gas cooler/condenser 2 is shown outputting the cooled and/or condensed $CO_2$ refrigerant into fluid conduit 3.

High pressure valve 4 receives the cooled and/or condensed $CO_2$ refrigerant from fluid conduit 3 and outputs the $CO_2$ refrigerant to fluid conduit 5. High pressure valve 4 may control the pressure of the $CO_2$ refrigerant in gas cooler/condenser 2 by controlling an amount of $CO_2$ refrigerant permitted to pass through high pressure valve 4. In some embodiments, high pressure valve 4 is a high pressure thermal expansion valve (e.g., if the pressure in fluid conduit 3 is greater than the pressure in fluid conduit 5). In such embodiments, high pressure valve 4 may allow the $CO_2$ refrigerant to expand to a lower pressure state. The expansion process may be an isenthalpic and/or adiabatic expansion process, resulting in a flash evaporation of the high pressure $CO_2$ refrigerant to a lower pressure, lower temperature state. The expansion process may produce a liquid/vapor mixture (e.g., having a thermodynamic quality between 0 and 1). In some embodiments, the $CO_2$ refrigerant expands to a pressure of approximately 38 bar (e.g., about 540 psig), which corresponds to a temperature of approximately 37° F. The $CO_2$ refrigerant then flows from fluid conduit 5 into receiving tank 6.

Receiving tank 6 collects the $CO_2$ refrigerant from fluid conduit 5. In some embodiments, receiving tank 6 may be a flash tank or other fluid reservoir. Receiving tank 6 includes a $CO_2$ liquid portion and a $CO_2$ vapor portion and may contain a partially saturated mixture of $CO_2$ liquid and $CO_2$ vapor. In some embodiments, receiving tank 6 separates the $CO_2$ liquid from the $CO_2$ vapor. The $CO_2$ liquid may exit receiving tank 6 through fluid conduits 9. Fluid conduits 9 may be liquid headers leading to either MT system portion 10 or LT system portion 20. The $CO_2$ vapor may exit receiving tank 6 through fluid conduit 7. Fluid conduit 7 is shown leading the $CO_2$ vapor to gas bypass valve 8.

Gas bypass valve 8 is shown receiving the $CO_2$ vapor from fluid conduit 7 and outputting the $CO_2$ refrigerant to MT system portion 10. In some embodiments, gas bypass valve 8 may be operated to regulate or control the pressure within receiving tank 6 (e.g., by adjusting an amount of $CO_2$ refrigerant permitted to pass through gas bypass valve 8). For example, gas bypass valve 8 may be adjusted (e.g., variably opened or closed) to adjust the mass flow rate, volume flow rate, or other flow rates of the $CO_2$ refrigerant through gas bypass valve 8. Gas bypass valve 8 may be opened and closed (e.g., manually, automatically, by a controller, etc.) as needed to regulate the pressure within receiving tank 6.

In some embodiments, gas bypass valve 8 includes a sensor for measuring a flow rate (e.g., mass flow, volume flow, etc.) of the $CO_2$ refrigerant through gas bypass valve 8. In other embodiments, gas bypass valve 8 includes an indicator (e.g., a gauge, a dial, etc.) from which the position of gas bypass valve 8 may be determined. This position may be used to determine the flow rate of $CO_2$ refrigerant through gas bypass valve 8, as such quantities may be proportional or otherwise related.

In some embodiments, gas bypass valve 8 may be a thermal expansion valve (e.g., if the pressure on the downstream side of gas bypass valve 8 is lower than the pressure in fluid conduit 7). According to one embodiment, the pressure within receiving tank 6 is regulated by gas bypass valve 8 to a pressure of approximately 38 bar, which corresponds to about 37° F. Advantageously, this pressure/temperature state (i.e., approximately 38 bar, approximately 37° F.) may facilitate the use of copper tubing/piping for the downstream $CO_2$ lines of the system. Additionally, this pressure/temperature state may allow such copper tubing to operate in a substantially frost-free manner.

Still referring to FIG. 1, MT system portion 10 is shown to include one or more expansion valves 11, one or more MT evaporators 12, and one or more MT compressors 14. In various embodiments, any number of expansion valves 11, MT evaporators 12, and MT compressors 14 may be present. Expansion valves 11 may be electronic expansion valves or other similar expansion valves. Expansion valves 11 are shown receiving liquid $CO_2$ refrigerant from fluid conduit 9 and outputting the $CO_2$ refrigerant to MT evaporators 12. Expansion valves 11 may cause the $CO_2$ refrigerant to undergo a rapid drop in pressure, thereby expanding the $CO_2$ refrigerant to a lower pressure, lower temperature state. In some embodiments, expansion valves 11 may expand the $CO_2$ refrigerant to a pressure of approximately 30 bar. The expansion process may be an isenthalpic and/or adiabatic expansion process.

MT evaporators 12 are shown receiving the cooled and expanded $CO_2$ refrigerant from expansion valves 11. In some embodiments, MT evaporators may be associated with display cases/devices (e.g., if $CO_2$ refrigeration system 100 is implemented in a supermarket setting). MT evaporators 12 may be configured to facilitate the transfer of heat from the display cases/devices into the $CO_2$ refrigerant. The added heat may cause the $CO_2$ refrigerant to evaporate partially or completely. According to one embodiment, the $CO_2$ refrigerant is fully evaporated in MT evaporators 12. In some embodiments, the evaporation process may be an isobaric process. MT evaporators 12 are shown outputting the $CO_2$ refrigerant via fluid conduits 13, leading to MT compressors 14.

MT compressors 14 compress the $CO_2$ refrigerant into a superheated vapor having a pressure within a range of approximately 45 bar to approximately 100 bar. The output pressure from MT compressors 14 may vary depending on ambient temperature and other operating conditions. In some embodiments, MT compressors 14 operate in a transcritical mode. In operation, the $CO_2$ discharge gas exits MT compressors 14 and flows through fluid conduit 1 into gas cooler/condenser 2.

Still referring to FIG. 1, LT system portion 20 is shown to include one or more expansion valves 21, one or more LT evaporators 22, and one or more LT compressors 24. In various embodiments, any number of expansion valves 21, LT evaporators 22, and LT compressors 24 may be present. In some embodiments, LT system portion 20 may be omitted and the $CO_2$ refrigeration system 100 may operate with an AC module interfacing with only MT system 10.

Expansion valves 21 may be electronic expansion valves or other similar expansion valves. Expansion valves 21 are shown receiving liquid $CO_2$ refrigerant from fluid conduit 9 and outputting the $CO_2$ refrigerant to LT evaporators 22. Expansion valves 21 may cause the $CO_2$ refrigerant to undergo a rapid drop in pressure, thereby expanding the $CO_2$ refrigerant to a lower pressure, lower temperature state. The expansion process may be an isenthalpic and/or adiabatic expansion process. In some embodiments, expansion valves 21 may expand the $CO_2$ refrigerant to a lower pressure than expansion valves 11, thereby resulting in a lower temperature $CO_2$ refrigerant. Accordingly, LT system portion 20 may be used in conjunction with a freezer system or other lower temperature display cases.

LT evaporators 22 are shown receiving the cooled and expanded $CO_2$ refrigerant from expansion valves 21. In some embodiments, LT evaporators may be associated with display cases/devices (e.g., if $CO_2$ refrigeration system 100 is implemented in a supermarket setting). LT evaporators 22 may be configured to facilitate the transfer of heat from the display cases/devices into the $CO_2$ refrigerant. The added heat may cause the $CO_2$ refrigerant to evaporate partially or completely. In some embodiments, the evaporation process may be an isobaric process. LT evaporators 22 are shown outputting the $CO_2$ refrigerant via fluid conduit 23, leading to LT compressors 24.

LT compressors 24 compress the $CO_2$ refrigerant. In some embodiments, LT compressors 24 may compress the $CO_2$ refrigerant to a pressure of approximately 30 bar (e.g., about 425 psig) having a saturation temperature of approximately 23° F. (e.g., about −5° C.). LT compressors 24 are shown outputting the $CO_2$ refrigerant through fluid conduit 25. Fluid conduit 25 may be fluidly connected with the suction (e.g., upstream) side of MT compressors 14.

In some embodiments, the $CO_2$ vapor that is bypassed through gas bypass valve 8 is mixed with the $CO_2$ refrigerant gas exiting MT evaporators 12 (e.g., via fluid conduit 13). The bypassed $CO_2$ vapor may also mix with the discharge $CO_2$ refrigerant gas exiting LT compressors 24 (e.g., via fluid conduit 25). The combined $CO_2$ refrigerant gas may be provided to the suction side of MT compressors 14.

Figure 2:
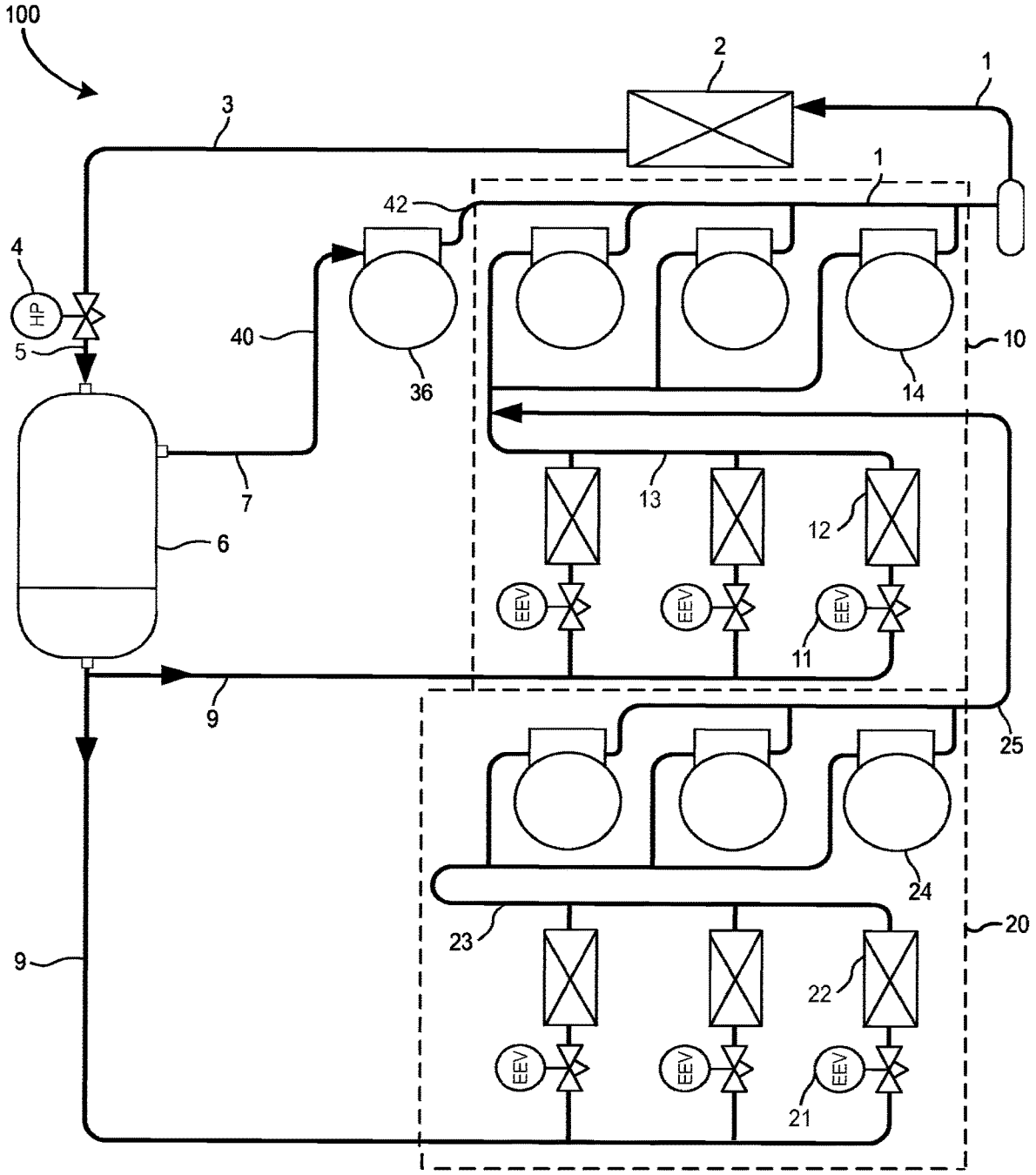
FIG. 2 is a schematic representation of the $CO_2$ refrigeration system of FIG. 1 having a parallel compressor fluidly connected with the receiving tank and arranged in parallel with other compressors of the $CO_2$ refrigeration system, the parallel compressor replacing the gas bypass valve for controlling the pressure within the receiving tank, according to an exemplary embodiment.

Referring now to FIG. 2, $CO_2$ refrigeration system 100 is shown, according to another exemplary embodiment. The embodiment illustrated in FIG. 2 includes many of the same components previously described with reference to FIG. 1. For example, the embodiment shown in FIG. 2 is shown to include gas cooler/condenser 2, high pressure valve 4, receiving tank 6, MT system portion 10, and LT system portion 20. However, the embodiment shown in FIG. 2 differs from the embodiment shown in FIG. 1 in that gas bypass valve 8 has been removed and replaced with a parallel compressor 36.

Parallel compressor 36 may be arranged in parallel with other compressors of $CO_2$ refrigeration system 100 (e.g., MT compressors 14, LT compressors 24, etc.). Although only one parallel compressor 36 is shown, any number of parallel compressors may be present. Parallel compressor 36 may be fluidly connected with receiving tank 6 and/or fluid conduit 7 via a connecting line 40. Parallel compressor 36 may be used to draw uncondensed $CO_2$ vapor from receiving tank 6 as a means for pressure control and regulation. Advantageously, using parallel compressor 36 to effectuate pressure control and regulation may provide a more efficient alternative to traditional pressure regulation techniques such as bypassing $CO_2$ vapor through bypass valve 8 to the lower pressure suction side of MT compressors 14.

In some embodiments, parallel compressor 36 may be operated (e.g., by a controller) to achieve a desired pressure within receiving tank 6. For example, the controller may receive pressure measurements from a pressure sensor monitoring the pressure within receiving tank 6 and activate or deactivate parallel compressor 36 based on the pressure measurements. When active, parallel compressor 36 compresses the $CO_2$ vapor received via connecting line 40 and discharges the compressed vapor into connecting line 42. Connecting line 42 may be fluidly connected with fluid conduit 1. Accordingly, parallel compressor 36 may operate in parallel with MT compressors 14 by discharging the compressed $CO_2$ vapor into a shared fluid conduit (e.g., fluid conduit 1).

Figure 3:
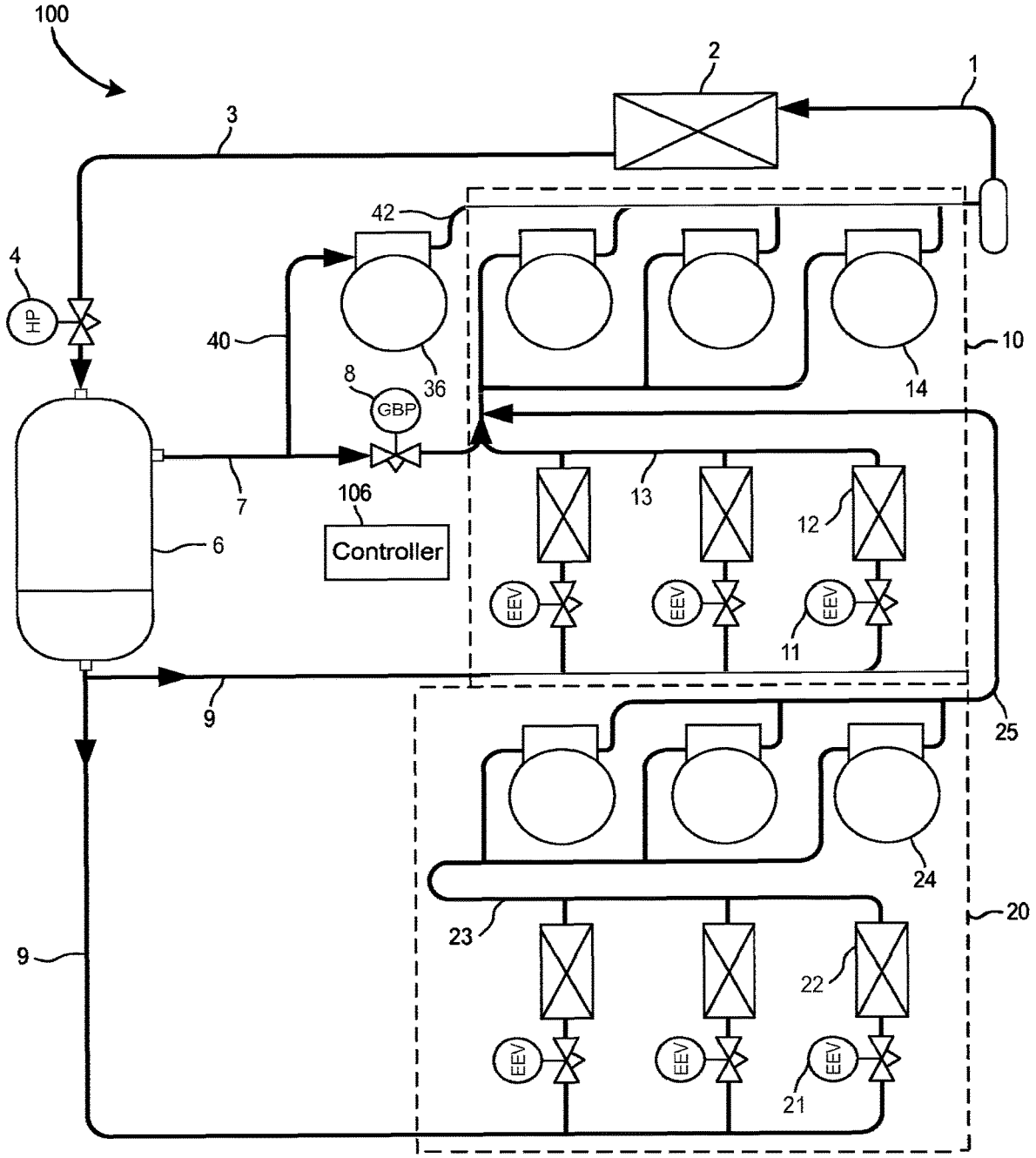
FIG. 3 is a schematic representation of the $CO_2$ refrigeration system of FIG. 1 having the parallel compressor of FIG. 2, the gas bypass valve of FIG. 1 arranged in parallel with the parallel compressor, and a controller configured to provide control signals to the parallel compressor and gas bypass valve for controlling pressure within the receiving tank using both the gas bypass valve and the parallel compressor, according to an exemplary embodiment.

Referring now to FIG. 3, $CO_2$ refrigeration system 100 is shown, according to another exemplary embodiment. The embodiment illustrated in FIG. 3 is shown to include all of the same components previously described with reference to FIG. 1. For example, the embodiment shown in FIG. 3 includes gas cooler/condenser 2, high pressure valve 4, receiving tank 6, gas bypass valve 8, MT system portion 10, and LT system portion 20. Additionally, the embodiment shown in FIG. 3 is shown to include parallel compressor 36, connecting line 40, and connecting line 42, as described with reference to FIG. 2.

As illustrated in FIG. 3, gas bypass valve 8 may be arranged in series with MT compressors 14. In other words, $CO_2$ vapor from receiving tank 6 may pass through both gas bypass valve 8 and MT compressors 14. MT compressors 14 may compress the $CO_2$ vapor passing through gas bypass valve 8 from a low pressure state (e.g., approximately 30 bar or lower) to a high pressure state (e.g., 45-100 bar). In some embodiments, the pressure immediately downstream of gas bypass valve 8 (i.e., in fluid conduit 13) is lower than the pressure immediately upstream of gas bypass valve 8 (i.e., in fluid conduit 7). Therefore, the $CO_2$ vapor passing through gas bypass valve 8 and MT compressors 14 may be expanded (e.g., when passing through gas bypass valve 8) and subsequently recompressed (e.g., by MT compressors 14). This expansion and recompression may occur without any intermediate transfers of heat to or from the $CO_2$ refrigerant, which can be characterized as an inefficient energy usage.

Parallel compressor 36 may be arranged in parallel with both gas bypass valve 8 and with MT compressors 14. In other words, $CO_2$ vapor exiting receiving tank 6 may pass through either parallel compressor 36 or the series combination of gas bypass valve 8 and MT compressors 14. Parallel compressor 36 may receive the $CO_2$ vapor at a relatively higher pressure (e.g., from fluid conduit 7) than the $CO_2$ vapor received by MT compressors 14 (e.g., from fluid conduit 13). This differential in pressure may correspond to the pressure differential across gas bypass valve 8. In some embodiments, parallel compressor 36 may require less energy to compress an equivalent amount of $CO_2$ vapor to the high pressure state (e.g., in fluid conduit 1) as a result of the higher pressure of $CO_2$ vapor entering parallel compressor 36. Therefore, the parallel route including parallel compressor 36 may be a more efficient alternative to the route including gas bypass valve 8 and MT compressors 14.

Still referring to FIG. 3, in some embodiments, $CO_2$ refrigeration system 100 includes a controller 106. Controller 106 may receive electronic data signals from various instrumentation or devices within $CO_2$ refrigeration system 100. For example, controller 106 may receive data input from timing devices, measurement devices (e.g., pressure sensors, temperature sensors, flow sensors, etc.), and user input devices (e.g., a user terminal, a remote or local user interface, etc.). Controller 106 may use the input to determine appropriate control actions for one or more devices of $CO_2$ refrigeration system 100. For example, controller 106 may provide output signals to operable components (e.g., valves, power supplies, flow diverters, compressors, etc.) to control a state or condition (e.g., temperature, pressure, flow rate, power usage, etc.) of system 100.

In some embodiments, controller 106 may be configured to operate gas bypass valve 8 and/or parallel compressor 36 to maintain the $CO_2$ pressure within receiving tank at a desired setpoint or within a desired range. In some embodiments, controller 106 may regulate or control the $CO_2$ refrigerant pressure within gas cooler/condenser 2 by operating high pressure valve 4. Advantageously, controller 106 may operate high pressure valve 4 in coordination with gas bypass valve 8 and/or other operable components of system 100 to facilitate improved control functionality and maintain a proper balance of $CO_2$ pressures, temperatures, flow rates, or other quantities (e.g., measured or calculated) at various locations throughout system 100 (e.g., in fluid conduits 1, 3, 5, 7, 9, 13 or 25, in gas cooler/condenser 2, in receiving tank 6, in connecting lines 40 and 42, etc.). Controller 106 and several exemplary control processes are described in greater detail with reference to FIGS. 7-11.

Figure 4:
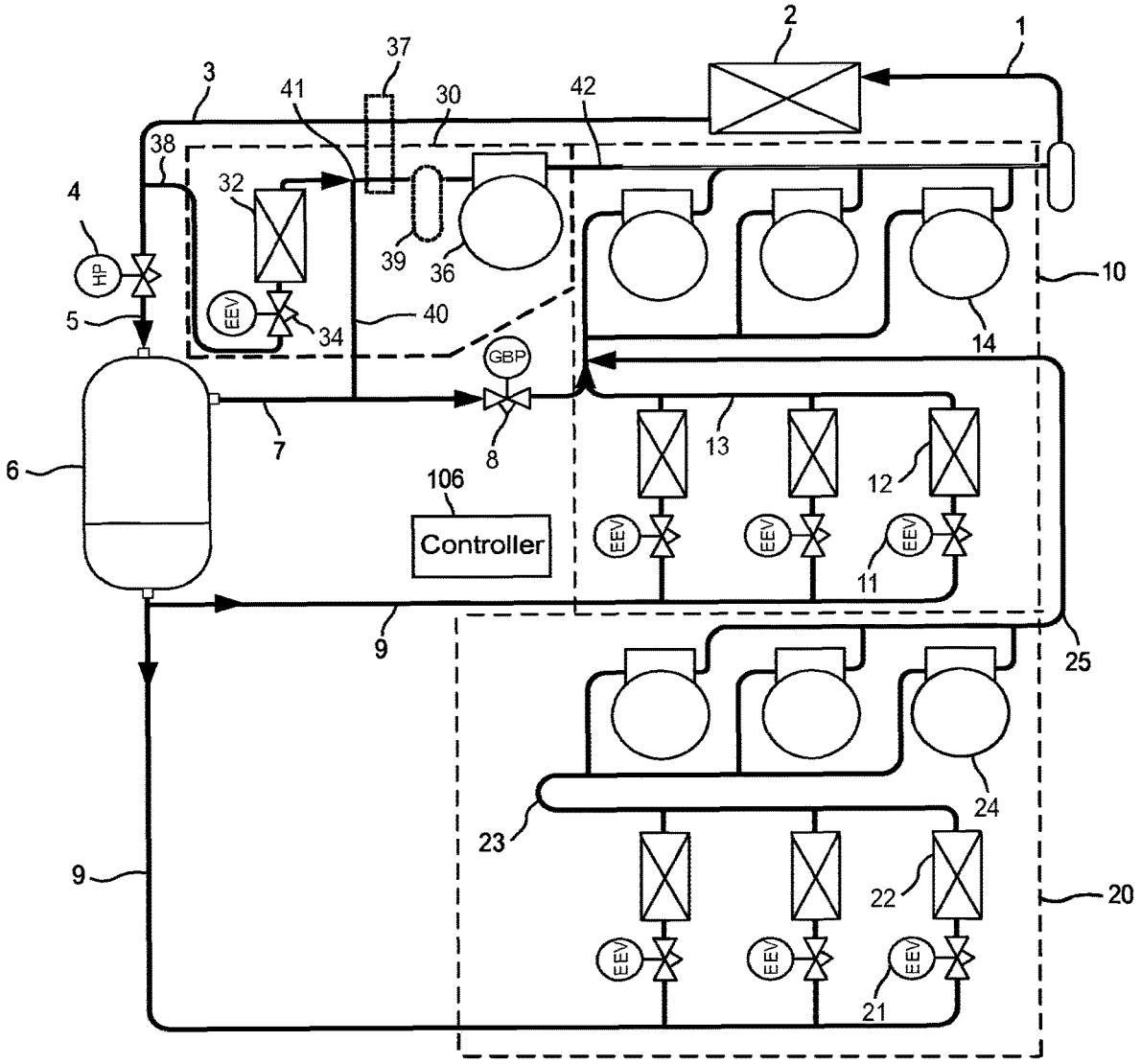
FIG. 4 is a schematic representation of the $CO_2$ refrigeration system of FIG. 3 having a flexible AC module for integrating cooling for air conditioning loads in the facility, according to an exemplary embodiment.
Figure 5:
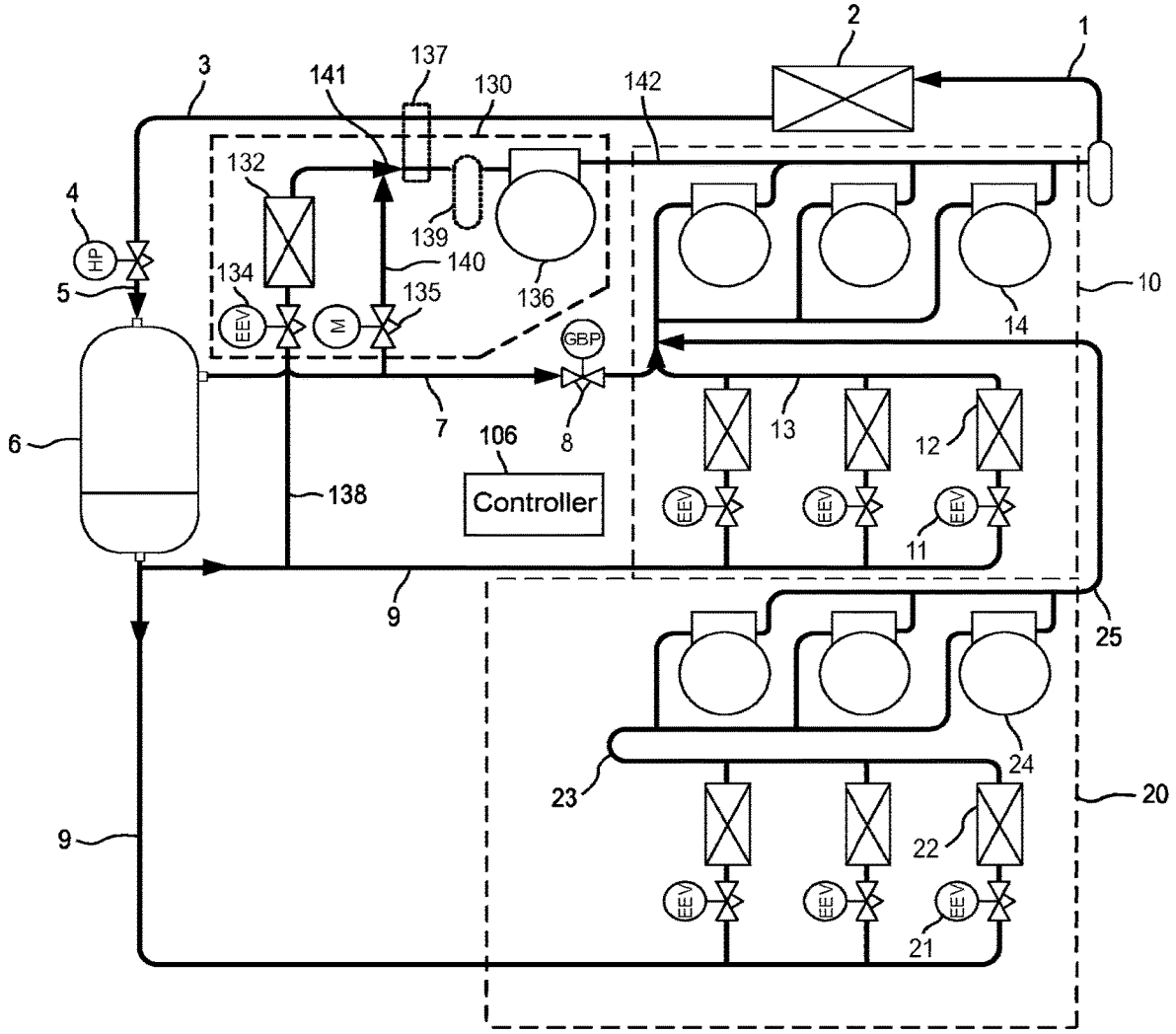
FIG. 5 is a schematic representation of the $CO_2$ refrigeration system of FIG. 3 having another flexible AC module for integrating cooling for air conditioning loads in the facility, according to another exemplary embodiment.
Figure 6:
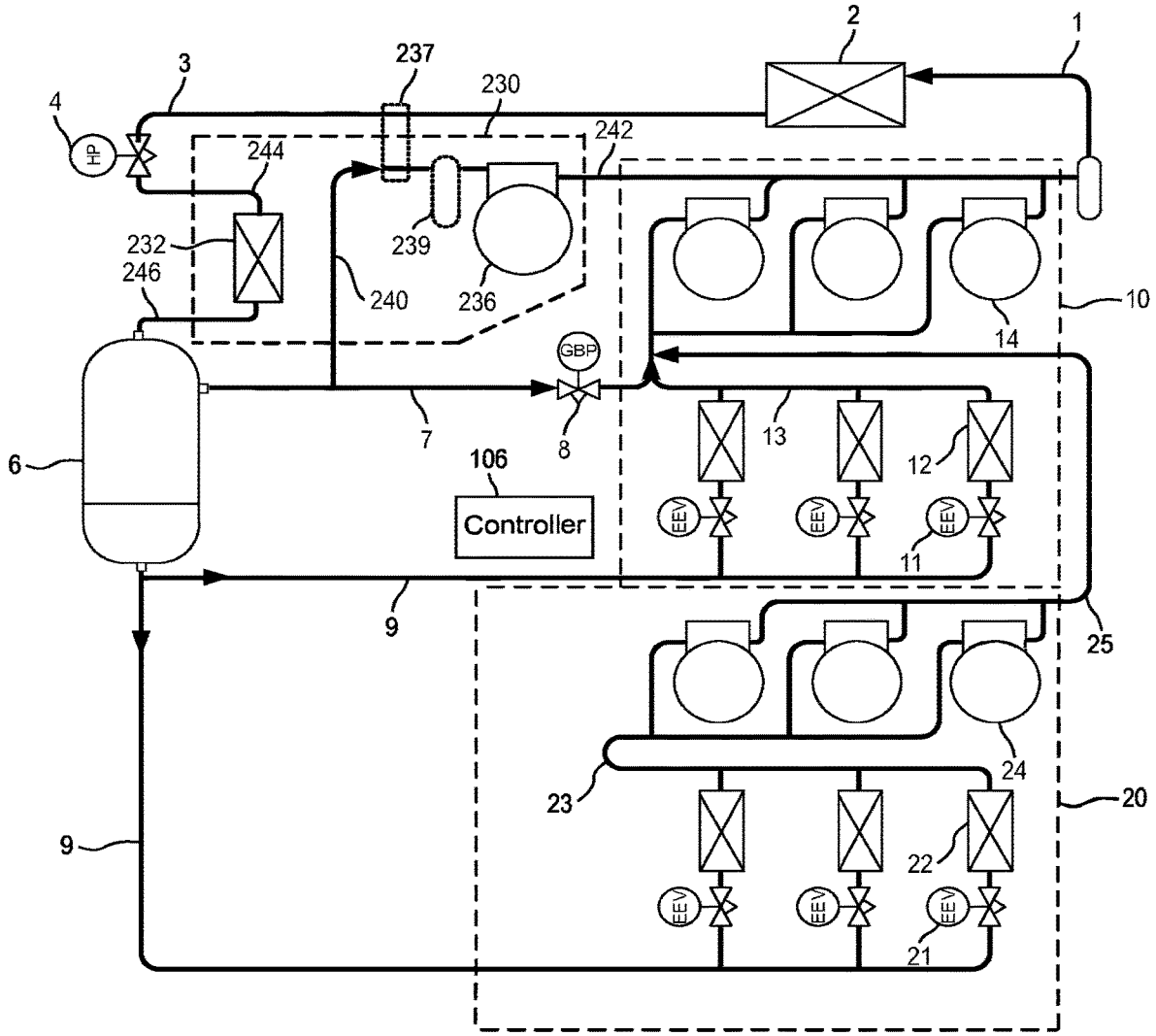
FIG. 6 is a schematic representation of the $CO_2$ refrigeration system of FIG. 3 having yet another flexible AC module for integrating cooling for air conditioning loads in the facility, according to another exemplary embodiment.

Referring now to FIGS. 4-6, in some embodiments, $CO_2$ refrigeration system 100 includes an integrated air conditioning (AC) module 30, 130, or 230. Referring specifically to FIG. 4, AC module 30 is shown to include an AC evaporator 32 (e.g., a liquid chiller, a fan-coil unit, a heat exchanger, etc.), an expansion device 34 (e.g. an electronic expansion valve), and at least one AC compressor 36. In some embodiments, flexible AC module 30 further includes a suction line heat exchanger 37 and $CO_2$ liquid accumulator 39. The size and capacity of the AC module 30 may be varied to suit any intended load or application by varying the number and/or size of evaporators, heat exchangers, and/or compressors within AC module 30.

Advantageously, AC module 30 may be readily connectible to $CO_2$ refrigeration system 100 using a relatively small number (e.g., a minimum number) of connection points. According to an exemplary embodiment, AC module 30 may be connected to $CO_2$ refrigeration system 100 at three connection points: a high-pressure liquid $CO_2$ line connection 38, a lower-pressure $CO_2$ vapor line (gas bypass) connection 40, and a $CO_2$ discharge line 42 (to gas cooler/condenser 2). Each of connections 38, 40 and 42 may be readily facilitated using flexible hoses, quick disconnect fittings, highly compatible valves, and/or other convenient "plug-and-play" hardware components. In some embodiments, some or all of connections 38, 40, and 42 may be arranged to take advantage of the pressure differential between gas cooler/condenser 2 and receiving tank 6.

As shown in FIG. 4, when AC module 30 is installed in $CO_2$ refrigeration system 100, AC compressor 36 may operate in parallel with MT compressors 14. For example, a portion of the high pressure $CO_2$ refrigerant discharged from gas cooler/condenser 2 (e.g., into fluid conduit 3) may be directed through $CO_2$ liquid line connection 38 and through expansion device 34. Expansion device 34 may allow the high pressure $CO_2$ refrigerant to expand a lower pressure, lower temperature state. The expansion process may be an isenthalpic and/or adiabatic expansion process. The expanded $CO_2$ refrigerant may then be directed into AC evaporator 32. In some embodiments, expansion device 34 adjusts the amount of $CO_2$ provided to AC evaporator 32 to maintain a desired superheat temperature at (or near) the outlet of the AC evaporator 32. After passing through AC evaporator 32, the $CO_2$ refrigerant may be directed through suction line heat exchanger 37 and $CO_2$ liquid accumulator 39 to the suction (i.e., upstream) side of AC compressor 36.

In some embodiments, AC evaporator 32 acts as a chiller to provide a source of cooling (e.g., building zone cooling, ambient air cooling, etc.) for the facility in which $CO_2$ refrigeration system 100 is implemented. In some embodiments, AC evaporator 32 absorbs heat from an AC coolant that circulates to the AC loads in the facility. In other embodiments, AC evaporator 32 may be used to provide cooling directly to air in the facility.

According to an exemplary embodiment, AC evaporator 32 is operated to maintain a $CO_2$ refrigerant temperature of approximately 37° F. (e.g., corresponding to a pressure of approximately 38 bar). AC evaporator 32 may maintain this temperature and/or pressure at an inlet of AC evaporator 32, an outlet of AC evaporator 32, or at another location within AC module 30. In other embodiments, expansion device 34 may maintain a desired $CO_2$ refrigerant temperature. The $CO_2$ refrigerant temperature maintained by AC evaporator 32 or expansion device 34 (e.g., approximately 37° F.) may be well-suited in most applications for chilling an AC coolant supply (e.g. water, water/glycol, or other AC coolant which expels heat to the $CO_2$ refrigerant). The AC coolant may be chilled to a temperature of about 45° F. or other temperature desirable for AC cooling applications in many types of facilities.

Advantageously, integrating AC module 30 with $CO_2$ refrigeration system 100 may increase the efficiency of $CO_2$ refrigeration system 100. For example, during warmer periods (e.g. summer months, mid-day, etc.) the $CO_2$ refrigerant pressure within gas cooler/condenser 2 tends to increase. Such warmer periods may also result in a higher AC cooling load required to cool the facility. By integrating AC module 30 with refrigeration system 100, the additional $CO_2$ capacity (e.g., the higher pressure in gas cooler/condenser 2) may be used advantageously to provide cooling for the facility. The dual effects of warmer environmental temperatures (e.g., higher $CO_2$ refrigerant pressure and an increased cooling load requirement) may both be addressed and resolved in an efficient and synergistic manner by integrating AC module 30 with $CO_2$ refrigeration system 100.

Additionally, AC module 30 can be used to more efficiently regulate the $CO_2$ pressure in receiving tank 6. Such pressure regulation may be accomplished by drawing $CO_2$ vapor directly from the receiving tank 6, thereby avoiding (or minimizing) the need to bypass $CO_2$ vapor from the receiving tank 6 to the lower-pressure suction side of the MT compressors 14 (e.g., through gas bypass valve 8). When AC module 30 is integrated with $CO_2$ refrigeration system 100, $CO_2$ vapor from receiving tank 6 is provided through $CO_2$ vapor line connection 40 to the downstream side of AC evaporator 32 and the suction side of AC compressor 36. Such integration may establish an alternate (or supplemental) path for bypassing $CO_2$ vapor from receiving tank 6, as may be necessary to maintain the desired pressure (e.g., approximately 38 bar) within receiving tank 6.

In some embodiments, AC module 30 draws its supply of $CO_2$ refrigerant from line 38, thereby reducing the amount of $CO_2$ that is received within receiving tank 6. In the event that the pressure in receiving tank 6 increases above the desired pressure (e.g. 38 bar, etc.), $CO_2$ vapor can be drawn by AC compressor 36 through $CO_2$ vapor line 40 in an amount sufficient to maintain the desired pressure within receiving tank 6. The ability to use the $CO_2$ vapor line 40 and AC compressor 36 as a supplemental bypass path for $CO_2$ vapor from receiving tank 6 provides a more efficient way to maintain the desired pressure in receiving tank 6 and avoids or minimizes the need to directly bypass $CO_2$ vapor across gas bypass valve 8 to the lower-pressure suction side of the MT compressors 14.

Still referring to FIG. 4, at intersection 41, the $CO_2$ vapor discharged from AC evaporator 32 may be mixed with $CO_2$ vapor output from receiving tank 6 (e.g., through fluid conduit 7 and vapor line 40, as necessary for pressure regulation). The mixed $CO_2$ vapor may then be directed through suction line heat exchanger 37 and liquid $CO_2$ accumulator 39 to the suction (e.g., upstream) side of AC compressor 36. AC compressor 36 compresses the mixed $CO_2$ vapor and discharges the compressed $CO_2$ refrigerant into connection line 42. Connection line 42 may be fluidly connected to fluid conduit 1, thereby forming a common discharge header with MT compressors 14. The common discharge header is shown leading to gas cooler/condenser 2 to complete the cycle.

Suction line heat exchanger 37 may be used to transfer heat from the high pressure $CO_2$ refrigerant exiting gas cooler/condenser 2 (e.g., via fluid conduit 3) to the mixed $CO_2$ refrigerant at or near intersection 41. Suction line heat exchanger 37 may help cool/sub-cool the high pressure $CO_2$ refrigerant in fluid conduit 3. Suction line heat exchanger 37 may also assist in ensuring that the $CO_2$ refrigerant approaching the suction of AC compressor 36 is sufficiently superheated (e.g., having a superheat or temperature exceeding a threshold value) to prevent condensation or liquid formation on the upstream side of AC compressor 36. In some embodiments, $CO_2$ liquid accumulator 39 may also be included to further prevent any $CO_2$ liquid from entering AC compressor 36.

Still referring to FIG. 4, AC module 30 may be integrated with $CO_2$ refrigeration system 100 such that integrated system can adapt to a loss of AC compressor 36 (e.g. due to equipment malfunction, maintenance, etc.), while still maintaining cooling for the AC loads and still providing $CO_2$ pressure control for receiving tank 6. For example, in the event that AC compressor 36 becomes non-functional, the $CO_2$ vapor discharged from AC evaporator 32 may be automatically (i.e. upon loss of suction from the AC compressor) directed back through $CO_2$ vapor line connection 40 toward fluid conduit 7. As the $CO_2$ refrigerant pressure increases in receiving tank 6 above the desired setpoint (e.g. 38 bar), the $CO_2$ vapor can be bypassed through gas bypass valve 8 and compressed by MT compressors 14. The parallel compressor arrangement of AC compressor 36 and MT compressors 14 allows for continued operation of AC module 30 in the event of an inoperable AC compressor 36.

Referring now to FIG. 5, another flexible AC module 130 for integrating AC cooling loads in a facility with $CO_2$ refrigeration system 100 is shown, according to another exemplary embodiment. AC Module 130 is shown to include an AC evaporator 132 (e.g., a liquid chiller, a fan-coil unit, a heat exchanger, etc.), an expansion device 134 (e.g. an electronic expansion valve), and at least one AC compressor 136. In some embodiments, flexible AC module 30 further includes a suction line heat exchanger 137 and $CO_2$ liquid accumulator 139. AC evaporator 132, expansion device 134, AC compressor 136, suction line heat exchanger 137, and $CO_2$ liquid accumulator 139 may be the same or similar to analogous components (e.g., AC evaporator 32, expansion device 34, AC compressor 36, suction line heat exchanger 37, and $CO_2$ liquid accumulator 39) of AC module 30. The size and capacity of AC module 130 may be varied to suit any intended load or application (e.g., by varying the number and/or size of evaporators, heat exchangers, and/or compressors within AC module 130.

In some embodiments, AC module 130 is readily connectible to $CO_2$ refrigeration system 100 by a relatively small number (e.g., a minimum number) of connection points. According to an exemplary embodiment, AC module 130 may be connected to $CO_2$ refrigeration system 100 at three connection points: a liquid $CO_2$ line connection 138, a $CO_2$ vapor line connection 140, and a $CO_2$ discharge line 142. Liquid $CO_2$ line connection 138 is shown connecting to fluid conduit 9 and may receive liquid $CO_2$ refrigerant from receiving tank 6. $CO_2$ vapor line connection 140 is shown connecting to fluid conduit 7 and may receive $CO_2$ bypass gas from receiving tank 6. $CO_2$ discharge line 142 is shown connecting the output (e.g., downstream side) of AC compressor 136 to fluid conduit 1, leading to gas cooler/condenser 2. Each of connections 138, 140 and 142 may be readily facilitated using flexible hoses, quick disconnect fittings, highly compatible valves, and/or other convenient "plug-and-play" hardware components.

In operation, a portion of the liquid $CO_2$ refrigerant exiting receiving tank 6 (e.g., via fluid conduit 9) may be directed through $CO_2$ liquid line connection 138 and through expansion device 134. Expansion device 34 may allow the liquid $CO_2$ refrigerant to expand a lower pressure, lower temperature state. The expansion process may be an isenthalpic and/or adiabatic expansion process. The expanded $CO_2$ refrigerant may then be directed into AC evaporator 132. In some embodiments, expansion device 134 adjusts the amount of $CO_2$ provided to AC evaporator 132 to maintain a desired superheat temperature at (or near) the outlet of the AC evaporator 132. After passing through AC evaporator 132, the $CO_2$ refrigerant may be directed through suction line heat exchanger 137 and $CO_2$ liquid accumulator 139 to the suction (i.e., upstream) side of AC compressor 136.

Still referring to FIG. 5, one primary difference between AC module 30 and AC module 130 is that AC module 130, avoids the high pressure $CO_2$ inlet (e.g., from fluid conduit 3) as a source of $CO_2$. Instead, AC module 130 uses a lower-pressure source of $CO_2$ refrigerant supply (e.g., from fluid conduit 9). Fluid conduit 9 may be fluidly connected with receiving tank 6 and may operate at a pressure equivalent or substantially equivalent to the pressure within receiving tank 6. In some embodiments, fluid conduit 9 provides liquid $CO_2$ refrigerant having a pressure of approximately 38 bar.

In some implementations, AC module 130 may be used as an alternative or supplement to AC module 30. The configuration provided by AC module 130 may be desirable for implementations in which AC evaporator 132 is not mounted on a refrigeration rack with the components of $CO_2$ refrigeration system 100. AC module 130 may be used for implementations in which AC evaporator 132 is located elsewhere in the facility (e.g. near the AC loads). Additionally, the lower pressure liquid $CO_2$ refrigerant provided to AC module 130 (e.g., from fluid conduit 9 rather than from fluid conduit 3) may facilitate the use of lower pressure components for routing the $CO_2$ refrigerant (e.g. copper tubing/piping, etc.).

In some embodiments, AC module 130 may include a pressure-reducing device 135. Pressure reducing-device 135 may be a motor-operated valve, a manual expansion valve, an electronic expansion valve, or other element capable of effectuating a pressure reduction in a fluid flow. Pressure-reducing device 135 may be positioned in line with vapor line connection 140 (e.g., between fluid conduit 7 and intersection 141). In some embodiments, pressure-reducing device 135 may reduce the pressure at the outlet of AC evaporator 132. In some embodiments, the heat absorption process which occurs within AC evaporator 132 is a substantially isobaric process. In other words, the $CO_2$ pressure at both the inlet and outlet of AC evaporator 132 may be substantially equal. Additionally, the $CO_2$ vapor in fluid conduit 7 and the liquid $CO_2$ in fluid conduit 9 may have substantially the same pressure since both fluid conduits 7 and 9 draw $CO_2$ refrigerant from receiving tank 6. Therefore, pressure-reducing device may provide a pressure drop substantially equivalent to the pressure drop caused by expansion device 134.

In some embodiments, line connection 140 may be used as an alternate (or supplemental) path for directing $CO_2$ vapor from receiving tank 6 to the suction of AC compressor 136. Line connection 140 and AC compressor 136 may provide a more efficient mechanism of controlling the pressure in receiving tank 6 (e.g., rather than bypassing the $CO_2$ vapor to the suction side of the MT compressors 14, as described with reference to AC module 30), thereby increasing the efficiency of $CO_2$ refrigeration system 100.

Referring now to FIG. 6, another flexible AC module 230 for integrating cooling loads in a facility with $CO_2$ refrigeration system 100 is shown, according to yet another exemplary embodiment. AC module 230 is shown to include an AC evaporator 232 (e.g., a liquid chiller, a fan-coil unit, a heat exchanger, etc.) and at least one AC compressor 236. In some embodiments, flexible AC module 30 further includes a suction line heat exchanger 237 and $CO_2$ liquid accumulator 239. AC evaporator 232, AC compressor 236, suction line heat exchanger 237, and $CO_2$ liquid accumulator 239 may be the same or similar to analogous components (e.g., AC evaporator 32, AC compressor 36, suction line heat exchanger 37, and $CO_2$ liquid accumulator 39) of AC module 30. AC module 230 does not require an expansion device as previously described with reference to AC modules 30 and 130 (e.g., expansion devices 34 and 134). The size and capacity of the AC module 230 may be varied to suit any intended load or application by varying the number and/or size of evaporators, heat exchangers, and/or compressors within AC module 230.

Advantageously, AC module 230 may be readily connectible to $CO_2$ refrigeration system 100 using a relatively small number (e.g., a minimum number) of connection points. According to an exemplary embodiment, AC module 30 may be connected to $CO_2$ refrigeration system 100 at two connection points: a $CO_2$ vapor line connection 240, and a $CO_2$ discharge line 242. $CO_2$ vapor line connection 240 is shown connecting to fluid conduit 7 and may receive (if necessary) $CO_2$ bypass gas from receiving tank 6. $CO_2$ discharge line 242 is shown connecting the output of AC compressor 236 to fluid conduit 1, which leads to gas cooler/condenser 2. Both of connections 240 and 242 may be readily facilitated using flexible hoses, quick disconnect fittings, highly compatible valves, and/or other convenient "plug-and-play" hardware components.

In some embodiments, AC module 230 has an inlet connection 244 and an outlet connection 246. Both inlet connection 244 and outlet connection 246 may connect (e.g., directly or indirectly) to respective inlet and outlet ports of AC evaporator 232. AC evaporator 232 may be positioned in line with fluid conduit 5 between high pressure valve 4 and receiving tank 6. AC evaporator 232 is shown receiving an entire mass flow of a the $CO_2$ refrigerant from gas cooler/condenser 2 and high pressure valve 4. AC evaporator 232 may receive the $CO_2$ refrigerant as a liquid-vapor mixture from high pressure valve 4. In some embodiments, the $CO_2$ liquid-vapor mixture is supplied to AC evaporator 232 at a temperature of approximately 3° C. In other embodiments, the $CO_2$ liquid-vapor mixture may have a different temperature (e.g., greater than 3° C., less than 3° C.) or a temperature within a range (e.g., including 3° C. or not including 3° C.).

Within AC evaporator 232, a portion of the $CO_2$ liquid in the mixture evaporates to chill a circulating AC coolant (e.g. water, water/glycol, or other AC coolant which expels heat to the $CO_2$ refrigerant). In some embodiments, the AC coolant may be chilled from approximately 12° C. to approximately 7° C. In other embodiments, other temperatures or temperature ranges may be used. The amount of $CO_2$ liquid which evaporates may depend on the cooling load (e.g., rate of heat transfer, cooling required to achieve a setpoint, etc.). After chilling the AC coolant, the entire mass flow of the $CO_2$ liquid-vapor mixture may exit AC evaporator 232 and AC module 230 (e.g., via outlet connection 246) and may be directed to receiving tank 6.

$CO_2$ refrigerant vapor in receiving tank 6 can exit receiving tank 6 via fluid conduit 7. Fluid conduit 7 is shown fluidly connected with the suction side of AC compressor 236 (e.g., by vapor line connection 240). In some embodiments, $CO_2$ vapor from receiving tank 6 travels through fluid conduit 7 and vapor line connection 240 and is compressed by AC compressor 236. AC compressor 236 may be controlled to regulate the pressure of $CO_2$ refrigerant within receiving tank 6. This method of pressure regulation may provide a more efficient alternative to bypassing the $CO_2$ vapor through gas bypass valve 8.

Advantageously, AC module 230 provides an AC evaporator that operates "in line" (e.g., in series, via a linear connection path, etc.) to use all of the $CO_2$ liquid-vapor mixture provided by high-pressure valve 4 for cooling the AC loads. This cooling may evaporate some or all of the liquid in the $CO_2$ mixture. After exiting AC module 230, the $CO_2$ refrigerant (now having an increased vapor content) is directed to receiving tank 6. From receiving tank 6, the $CO_2$ refrigerant and may readily be drawn by AC compressor 236 to control and/or maintain a desired pressure in receiving tank 6.

Referring generally to FIGS. 4-6, each of the illustrated embodiments is shown to include controller 106. Controller 106 may receive electronic data signals from one or more measurement devices (e.g., pressure sensors, temperature sensors, flow sensors, etc.) located within AC modules 30, 130, or 230 or elsewhere within $CO_2$ refrigeration system 100. Controller 106 may use the input signals to determine appropriate control actions for control devices of $CO_2$ refrigeration system 100 (e.g., compressors, valves, flow diverters, power supplies, etc.).

In some embodiments, controller 106 may be configured to operate gas bypass valve 8 and/or parallel compressors 36, 136, or 236 to maintain the $CO_2$ pressure within receiving tank 6 at a desired setpoint or within a desired range. In some embodiments, controller 106 operates gas bypass valve 8 and parallel compressors 36, 136, or 236 based on the temperature of the $CO_2$ refrigerant at the outlet of gas cooler/condenser 2. In other embodiments, controller 106 operates gas bypass valve 8 and parallel compressors 36, 136, or 236 based a flow rate (e.g., mass flow, volume flow, etc.) of $CO_2$ refrigerant through gas bypass valve 8. Controller 106 may use a valve position of gas bypass valve 8 as a proxy for $CO_2$ refrigerant flow rate.

Controller 106 may include feedback control functionality for adaptively operating gas bypass valve 8 and parallel compressors 36, 136, or 236. For example, controller 106 may receive a setpoint (e.g., a temperature setpoint, a pressure setpoint, a flow rate setpoint, a power usage setpoint, etc.) and operate one or more components of system 100 to achieve the setpoint. The setpoint may be specified by a user (e.g., via a user input device, a graphical user interface, a local interface, a remote interface, etc.) or automatically determined by controller 106 based on a history of data measurements.

Controller 106 may be a proportional-integral (PI) controller, a proportional-integral-derivative (PID) controller, a pattern recognition adaptive controller (PRAC), a model recognition adaptive controller (MRAC), a model predictive controller (MPC), or any other type of controller employing any type of control functionality. In some embodiments, controller 106 is a local controller for $CO_2$ refrigeration system 100. In other embodiments, controller 106 is a supervisory controller for a plurality of controlled subsystems (e.g., a refrigeration system, an AC system, a lighting system, a security system, etc.). For example, controller 106 may be a controller for a comprehensive building management system incorporating $CO_2$ refrigeration system 100. Controller 106 may be implemented locally, remotely, or as part of a cloud-hosted suite of building management applications.

Figure 7:
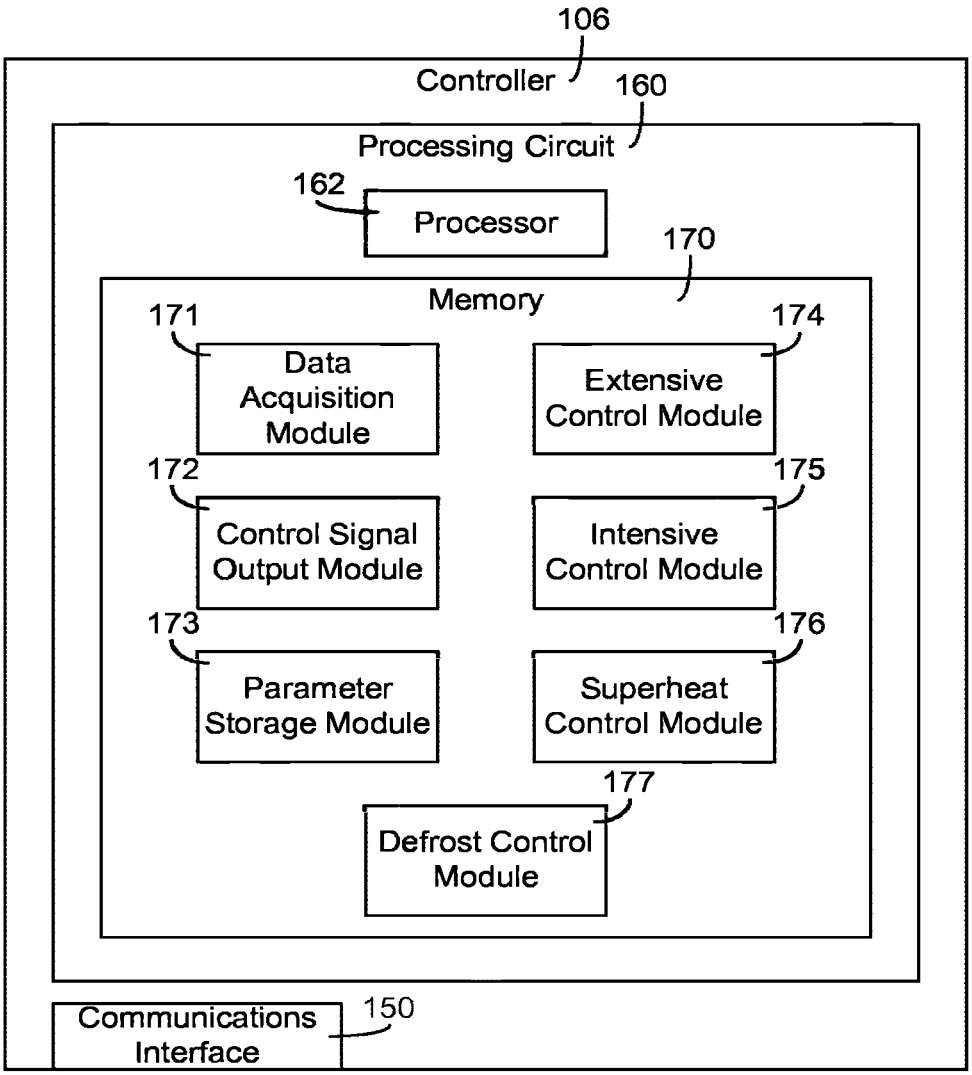
FIG. 7 is a block diagram illustrating the controller of FIG. 3 in greater detail, according to an exemplary embodiment.

Referring now to FIG. 7, a block diagram of controller 106 is shown, according to an exemplary embodiment. Controller 106 is shown to include a communications interface 150, and a processing circuit 160. Communications interface 150 can be or include wired or wireless interfaces (e.g., jacks, antennas, transmitters, receivers, transceivers, wire terminals, etc.) for conducting electronic data communications. For example, communications interface 150 may be used to conduct data communications with gas bypass valve 8, parallel compressors 36, 136, or 236, gas condenser/cooler 2, various data acquisition devices within $CO_2$ refrigeration system 100 (e.g., temperature sensors, pressure sensors, flow sensors, etc.) and/or other external devices or data sources. Data communications may be conducted via a direct connection (e.g., a wired connection, an ad-hoc wireless connection, etc.) or a network connection (e.g., an Internet connection, a LAN, WAN, or WLAN connection, etc.). For example, communications interface 150 can include an Ethernet card and port for sending and receiving data via an Ethernet-based communications link or network. In another example, communications interface 150 can include a WiFi transceiver or a cellular or mobile phone transceiver for communicating via a wireless communications network.

Still referring to FIG. 7, processing circuit 160 is shown to include a processor 162 and memory 170. Processor 162 can be implemented as a general purpose processor, an application specific integrated circuit (ASIC), one or more field programmable gate arrays (FPGAs), a group of processing components, a microcontroller, or other suitable electronic processing components. Memory 170 (e.g., memory device, memory unit, storage device, etc.) may be one or more devices (e.g., RAM, ROM, solid state memory, hard disk storage, etc.) for storing data and/or computer code for completing or facilitating the various processes, layers and modules described in the present application.

Memory 170 may be or include volatile memory or non-volatile memory. Memory 170 may include database components, object code components, script components, or any other type of information structure for supporting the various activities and information structures described in the present application. According to an exemplary embodiment, memory 170 is communicably connected to processor 162 via processing circuit 160 and includes computer code for executing (e.g., by processing circuit 160 and/or processor 162) one or more processes described herein. Memory 170 is shown to include a data acquisition module 171, a control signal output module 172, and a parameter storage module 173. Memory 170 is further shown to include a plurality of control modules including an extensive control module 174, an intensive control module 175, a superheat control module 176, and a defrost control module 177.

Data acquisition module 171 may include instructions for receiving (e.g., via communications interface 150) pressure information, temperature information, flow rate information, or other measurements (i.e., "measurement information" or "measurement data") from one or more measurement devices of $CO_2$ refrigeration system 100. In some embodiments, the measurements may be received as an analog data signal. Data acquisition module 171 may include an analog-to-digital converter for translating the analog signal into a digital data value. Data acquisition module may segment a continuous data signal into discrete measurement values by sampling the received data signal periodically (e.g., once per second, once per millisecond, once per minute, etc.). In some embodiments, the measurement data may be received as a measured voltage from one or more measurement devices. Data acquisition module 171 may convert the voltage values into pressure values, temperature values, flow rate values, or other types of digital data values using a conversion formula, a translation table, or other conversion criteria.

In some embodiments, data acquisition module 171 may convert received data values into a quantity or format for further processing by controller 106. For example, data acquisition module 171 may receive data values indicating an operating position of gas bypass valve 8. This position may be used to determine the flow rate of $CO_2$ refrigerant through gas bypass valve 8, as such quantities may be proportional or otherwise related. Data acquisition module 171 may include functionality to convert a valve position measurement into a flow rate of the $CO_2$ refrigerant through gas bypass valve 8.

In some embodiments, data acquisition module 171 outputs current data values for the pressure within receiving tank 6, the temperature at the outlet of gas cooler condenser 2, the valve position or flow rate through gas bypass valve 8, or other data values corresponding to other measurement devices of $CO_2$ refrigeration system 100. In some embodiments, data acquisition module stores the processed and/or converted data values in a local memory 170 of controller 106 or in a remote database such that the data may be retrieved and used by control modules 174-177.

In some embodiments, data acquisition module 171 may attach a time stamp to the received measurement data to organize the data by time. If multiple measurement devices are used to obtain the measurement data, module 171 may assign an identifier (e.g., a label, tag, etc.) to each measurement to organize the data by source. For example, the identifier may signify whether the measurement information is received from a temperature sensor located at an outlet of gas cooler/condenser 2, a temperature or pressure sensor located within receiving tank 6, a flow sensor located in line with gas bypass valve 8, or from gas bypass valve 8 itself. Data acquisition module 171 may further label or classify each measurement by type (e.g., temperature, pressure, flow rate, etc.) and assign appropriate units to each measurement (e.g., degrees Celsius (° C.), Kelvin (K), bar, kilo-Pascal (kPa), pounds force per square inch (psi), etc.).

Still referring to FIG. 7, memory 170 is shown to include a control signal output module 172. Control signal output module 172 may be responsible for formatting and providing a control signal (e.g., via communications interface 150) to various operable components of $CO_2$ refrigeration system 100. For example, control signal output module 172 may provide a control signal to gas bypass valve 8 instructing gas bypass valve 8 to open, close, or reach an intermediate operating position (e.g., between a completely open and completely closed position). Control signal output module 172 may provide a control signal to parallel compressors 36, 136, or 236, MT compressors 14, or LT compressors 24 instructing the compressors to activate or deactivate. Control signal output module 172 may provide a control signal to expansion valves 11, 21, 34, and 134 or to high pressure valve 4 instructing such valves to open, close, or to attain a desired operating position. In some embodiments, control signal output module may format the output signal to a proper format (e.g., proper language, proper syntax, etc.) as can be interpreted and applied by the various operable components of $CO_2$ refrigeration system 100.

Still referring to FIG. 7, memory 170 is shown to include a parameter storage module 173. Parameter storage module 173 may store threshold parameter information used by control modules 174-177 in performing the various control process described herein. For example, parameter storage module 173 may store a valve position threshold value "$pos_{threshold}$" for gas bypass valve 8. Extensive control module 174 may compare a current valve position "$pos_{bypass}$" of gas bypass valve 8 (e.g., as determined by data acquisition module 171) with the valve position threshold value in determining whether to activate or deactivate parallel compressors 36, 136, or 236. As another example, parameter storage module 173 may store an outlet temperature threshold value "$T_{threshold}$" for gas cooler/condenser 2. Intensive control module 175 and superheat control module 176 may compare a current outlet temperature "$T_{outlet}$" of the $CO_2$ refrigerant exiting gas cooler/condenser 2 (e.g., as determined by data acquisition module 171) with the outlet temperature threshold value $T_{outlet}$ in determining whether to activate or deactivate parallel compressors 36, 136, or 236. In some embodiments, parameter storage module 173 may store a set of alternate or backup threshold values as may be used during a hot gas defrost process (e.g., controlled by defrost control module 177).

In some embodiments, parameter storage module 173 may store configuration settings for $CO_2$ refrigeration system 100. Such configuration settings may include control parameters used by controller 106 (e.g., proportional gain parameters, integral time parameters, setpoint parameters, etc.), translation parameters for converting received data values into temperature or pressure values, system parameters for a stored system model of $CO_2$ refrigeration system 100 (e.g., as may be used for implementations in which controller 106 uses a model predictive control methodology), or other parameters as may be referenced by memory modules 171-177 in performing the various control processes described herein.

Still referring to FIG. 7, memory 170 is shown to include an extensive control module 174. Extensive control module 174 may include instructions for controlling the pressure within receiving tank 6 based on an extensive property of $CO_2$ refrigeration system 100. For example, extensive control module 174 may use the volume flow rate or mass flow rate of $CO_2$ refrigerant through gas bypass valve 8 as a basis for activating or deactivating parallel compressors 36, 136, or 236 or for opening or closing gas bypass valve 8. The mass flow rate or volume flow rate of the $CO_2$ refrigerant through gas bypass valve 8 is an extensive property because it depends on the amount of $CO_2$ refrigerant passing through gas bypass valve 8. In some embodiments, extensive control module 174 uses the position of gas bypass valve 8 (e.g., 10% open, 15% open, 40% open, etc.) as an indication of mass flow rate or volume flow rate as such quantities may be proportional or otherwise related.

In some embodiments, extensive control module 174 monitors a current position $pos_{bypass}$ of gas bypass valve 8. The current position $pos_{bypass}$ may be determined by data acquisition module 171 and stored in a local memory 170 of controller 106 or in a remote database accessible by controller 106. Extensive control module 174 may compare the current position $pos_{bypass}$ with a threshold valve position value $pos_{threshold}$ stored in parameter storage module 173. In an exemplary embodiment, $pos_{threshold}$ may be a valve position of approximately 15% open. However, in other embodiments, various other valve positions or valve position ranges may be used for $pos_{threshold}$ (e.g., 10% open, 20% open, between 5% open and 30% open, etc.). In some embodiments, extensive control module 174 activates parallel compressor 36, 136, or 236 in response to $pos_{bypass}$ exceeding $pos_{threshold}$. Once parallel compressor 36, 136, or 236 has been activated, extensive control module 174 may instruct gas bypass valve 8 to close.

In some embodiments, extensive control module 174 determines a duration "$t_{excess}$" for which the current position $pos_b$, has exceeded $pos_{threshold}$. For example, extensive control module 174 may use the timestamps recorded by data acquisition module 171 to determine the most recent time $t_0$ for which $pos_{bypass}$ did not exceed $pos_{threshold}$. Extensive control module 174 may calculate $t_{excess}$ by subtracting a time $t_1$ immediately after $t_0$ (e.g., a time at which $pos_{bypass}$ first exceeded $pos_{threshold}$, a time of the next data measurement after to, etc.) from the current time $t_k$ (e.g., $t_{excess}=t_k-t_1$). Extensive control module 174 may compare the duration $t_{excess}$ with a threshold time value "$t_{threshold}$" stored in parameter storage module 173. If $t_{exceeds}$ exceeds $t_{threshold}$ (e.g., $t_{excess}>t_{threshold}$), extensive control module 174 may activate parallel compressor 36, 136, or 236. In an exemplary embodiment, $t_{threshold}$ may be approximately 120 seconds. However, in other embodiments, various other values for $t_{threshold}$ may be used (e.g., 30 seconds, 60 seconds, 180 seconds, etc.). In some embodiments, extensive control module 174 activates parallel compressor 36, 136, or 236 only if both $pos_{bypass}>pos_{threshold}$ and $t_{excess}>t_{threshold}$.

In some embodiments, extensive control module 174 monitors a current temperature "$T_{outlet}$" of the $CO_2$ refrigerant exiting gas cooler/condenser 2. Extensive control module 174 may ensure that the $CO_2$ refrigerant exiting gas cooler/condenser 2 has the ability to provide sufficient superheat (e.g., via heat exchanger 37, 137, 237) to the $CO_2$ refrigerant flowing into parallel compressor 36, 136, or 236. The current temperature $T_{outlet}$ may be determined by data acquisition module 171 and stored in a local memory 170 of controller 106 or in a remote database accessible by controller 106. Extensive control module 174 may compare the current temperature $T_{outlet}$ with a threshold temperature value "$T_{threshold_outlet}$" stored in parameter storage module 173. The threshold temperature value $T_{threshold_outlet}$ may be based on the temperature $T_{condensation}$ at which the $CO_2$ refrigerant begins to condense into a liquid-vapor mixture. In some embodiments, the threshold temperature value $T_{threshold_outlet}$ may be based on an amount of heat predicted to transfer via heat exchanger 37, 137, or 237. In an exemplary embodiment, $T_{threshold_outlet}$ may be approximately 40° F. In other embodiments, $T_{threshold_outlet}$ may have other values (e.g., approximately 35° F., approximately 45° F., within a range between 30° F. and 50° F., etc.). In some embodiments, extensive control module 174 activates parallel compressor 36, 136, or 236 only if $pos_{bypass}>pos_{threshold}$, $t_{excess}>t_{threshold}$, and $T_{outlet}>T_{threshold_outlet}$. Extensive control module 174 may monitor these states and deactivate the parallel compressor if one or more of these conditions are no longer met.

In some embodiments, extensive control module 174 controls the pressure within receiving tank 6 by providing control signals to gas bypass valve 8 and/or parallel compressor 36, 136 or 236. The control signals may be based on the pressure "$P_{rec}$" within receiving tank 6. For example, extensive control module 174 may compare $P_{rec}$ with a threshold pressure value "$P_{threshold}$" stored in parameter storage module 173. Extensive control module 174 may operate parallel compressor 36, 136, or 236 and gas bypass valve 8 based on a result of the comparison.

In some embodiments, extensive control module 174 uses a plurality of threshold pressure values in determining whether to activate parallel compressor 36, 136, or 236 and/or open gas bypass valve 8. For example, the parallel compressor may have a threshold pressure value of "$P_{threshold_comp}$" and gas bypass valve 8 may have a threshold pressure value of "$P_{threshold_valve}$." $P_{threshold_valve}$ may initially be set to a relatively lower value "$P_{low}$" (e.g., $P_{threshold_valve}=P_{low}$) and $P_{threshold_comp}$ may initially be set to a relatively higher value "$P_{high}$" (e.g., $P_{threshold_comp}=P_{high}$). In some implementations, $P_{low}$ may be approximately 40 bar and $P_{high}$ may be approximately 42 bar. These numerical values are intended to be illustrative and non-limiting. In other implementations, higher or lower pressure values may be used for $P_{low}$ and/or $P_{high}$ (e.g., other than 40 bar and 42 bar). In some embodiments, $P_{threshold_valve}$ may have an initial value of approximately 30 bar. The initial value of $P_{threshold_valve}$ may be equal to the setpoint pressure $P_{rec_setpoint}$ for receiving tank 6 or based on the setpoint pressure for receiving tank 6 (e.g., $P_{rec_setpoint}$+10 bar, $P_{rec_setpoint}$+30 bar, etc.). In some embodiments, $P_{threshold_valve}$ may have an initial value within a range from 30 bar to 50 bar.

In some embodiments, so long as $pos_{bypass}<pos_{threshold}$, $t_{excess}<t_{threshold}$, or $T_{outlet}<T_{threshold_outlet}$, extensive control module 174 may control $P_{rec}$ by variably opening and closing gas bypass valve 8. However, if $pos_{bypass}>pos_{threshold}$, $t_{excess}>t_{threshold}$, and $T_{outlet}>T_{threshold_outlet}$, extensive control module 174 may activate parallel compressor 36, 136, or 236. The activation of the parallel compressor may be gradual and smooth (e.g., a ramp increase in compression rate, etc.).

In some embodiments, extensive control module 174 adaptively adjusts the values for $P_{threshold_valve}$ and/or $P_{threshold_comp}$. Such adjustment may be based on the current operating conditions of $CO_2$ refrigeration system 100 (e.g., whether gas bypass valve 8 is currently open, whether parallel compressor 36, 136, or 236 is currently active, etc.). Advantageously, the adaptive adjustment of $P_{threshold_valve}$ and $P_{threshold_comp}$ may prevent parallel compressor 36, 136 or 236 from rapidly activating and deactivating, thereby reducing power consumption and prolonging the life of the parallel compressors. In some embodiments, the values for both $P_{threshold_valve}$ and $P_{threshold_comp}$ are adjusted. In other embodiments, only one of the values for $P_{threshold_valve}$ or $P_{threshold_comp}$ is adjusted.

In some embodiments, extensive control module 174 adjusts the values for $P_{threshold_valve}$ and $P_{threshold_comp}$ upon activating parallel compressor 36, 136, or 236. Extensive control module 174 may adjust the threshold pressure values by swapping the values for $P_{threshold_valve}$ and $P_{threshold_comp}$. In other words, upon activating parallel compressor 36, 136, or 236, $P_{threshold_valve}$ may be set to $P_{high}$ and $P_{threshold_comp}$ may be set to $P_{low}$. In other embodiments, $P_{threshold_valve}$ and $P_{threshold_comp}$ may be set to other values (e.g., other than $P_{high}$ and $P_{low}$).

In some embodiments, $P_{threshold_valve}$ and $P_{threshold_comp}$ may be adjusted such that $P_{threshold_comp}<P_{threshold_valve}$. Upon activating parallel compressor 36, 136, or 236, extensive control module 174 may instruct gas bypass valve 8 to close. Gas bypass valve 8 may close slowly and smoothly. Extensive control module 174 may continue to regulate the pressure within receiving tank 6 using only parallel compressor 36, 136, or 236 so long as $P_{threshold_comp}<P_{rec}<P_{threshold_valve}$. Extensive control module 174 may increase or decrease a speed of the parallel compressor to maintain $P_{rec}$ at a setpoint.

In some embodiments, if $P_{rec}$ reaches a value above $P_{threshold_valve}$, extensive control module 174 may instruct the gas bypass valve 8 to open, thereby using both parallel compressor 36, 136, or 236 and gas bypass valve 8 to control $P_{rec}$. In some embodiments, if the parallel compressor becomes damaged, loses power, or otherwise becomes non-functional, gas bypass valve 8 may be used in place of parallel compressor 36, 136, 236, regardless of the pressure within $P_{rec}$. Advantageously, gas bypass valve 8 may function as a backup or safety pressure regulating mechanism in the event of a parallel compressor failure. In some embodiments, if $P_{rec}$ is reduced below $P_{threshold_comp}$, extensive control module 174 may instruct the parallel compressor to stop.

In some embodiments, extensive control module 174 adjusts the values for $P_{threshold_valve}$ and $P_{threshold_comp}$ upon deactivating parallel compressor 36, 136, or 236 (e.g., when $P_{rec}<P_{threshold_comp}$). Extensive control module 174 may adjust the threshold pressure values by swapping the values for $P_{threshold_valve}$ and $P_{threshold_comp}$. In other words, upon deactivating parallel compressor 36, 136, or 236, $P_{threshold_valve}$ may be set once again to $P_{low}$ and $P_{threshold_comp}$ may be set once again to $P_{high}$. In other embodiments, $P_{threshold_valve}$ and $P_{threshold_comp}$ may be set to other values (e.g., other than $P_{low}$ and $P_{high}$).

When the pressure within receiving tank 6 transitions from below $P_{threshold_valve}$ to above $P_{threshold_valve}$ (e.g., $P_{threshold_valve}<P_{rec}<P_{threshold_comp}$), extensive control module 174 may instruct gas bypass valve 8 to open. Extensive control module 174 may continue to regulate the pressure within receiving tank 6 using only gas bypass valve 8. However, if $pos_{bypass}>pos_{threshold}$, $t_{excess}>t_{threshold}$, and $T_{outlet}>T_{threshold_outlet}$, extensive control module 174 may again activate parallel compressor 36, 136, or 236 and the cycle may be repeated.

Still referring to FIG. 7, memory 170 is shown to include an intensive control module 175. Intensive control module 175 may include instructions for controlling the pressure within receiving tank 6 based on an intensive property of $CO_2$ refrigeration system 100. For example, intensive control module 175 may use the temperature of the $CO_2$ refrigerant at the outlet of gas cooler/condenser 2 as a basis for activating or deactivating parallel compressors 36, 136, or 236 or for opening or closing gas bypass valve 8. The temperature of the $CO_2$ refrigerant at the outlet of gas cooler/condenser 2 is an intensive property because it does not depend on the amount of $CO_2$ refrigerant passing gas cooler/condenser 2. In some embodiments, intensive control module 175 uses other intensive properties (e.g., enthalpy, pressure, internal energy, etc.) of the $CO_2$ refrigerant in place of or in addition to temperature. The intensive property may be measured or calculated from one or more measured quantities.

In some embodiments, intensive control module 175 monitors a current temperature $T_{outlet}$ of the $CO_2$ refrigerant at the outlet of gas cooler/condenser 2. The current temperature $T_{outlet}$ may be determined by data acquisition module 171 and stored in a local memory 170 of controller 106 or in a remote database accessible by controller 106. Intensive control module 175 may compare the current temperature $T_{outlet}$ with a threshold temperature value $T_{threshold}$ stored in parameter storage module 173. In an exemplary embodiment, $T_{threshold}$ may be approximately 13° C. However, in other embodiments, other values or ranges of values for $T_{threshold}$ may be used (e.g., 0° C., 5° C., 20° C., between 10° C. and 20° C., etc.). In some embodiments, intensive control module 175 activates parallel compressor 36, 136, or 236 in response to $T_{outlet}$ exceeding $T_{threshold}$. Once parallel compressor 36, 136, or 236 has been activated, intensive control module 175 may instruct gas bypass valve 8 to close.

In some embodiments, the $CO_2$ refrigerant exiting gas cooler/condenser 2 may be a partially condensed mixture of $CO_2$ vapor and $CO_2$ liquid. In such embodiments, intensive control module 175 may determine a thermodynamic quality "$\chi_{outlet}$" of the $CO_2$ refrigerant mixture at the outlet of gas cooler/condenser 2. The outlet quality $\chi_{outlet}$ may be a mass fraction of the mixture exiting gas cooler/condenser that is $CO_2$ vapor $$\left(\text{e.g., } \chi_{outlet} = \frac{m_{vapor}}{m_{total}}\right).$$

Intensive control module 175 may compare the current outlet quality $\chi_{outlet}$ with a threshold quality value "$\chi_{threshold}$" stored in parameter storage module 173. In some embodiments, intensive control module 175 activates parallel compressor 36, 136, or 236 in response to $\chi_{outlet}$ exceeding $\chi_{threshold}$ and/or $T_{outlet}$ exceeding $T_{threshold}$.

In some embodiments, intensive control module 175 determines a duration $t_{excess}$ for which the current temperature $T_{outlet}$ and or outlet quality $\chi_{outlet}$ has exceeded $T_{threshold}$ and/or $\chi_{threshold}$. For example, intensive control module 175 may use the timestamps recorded by data acquisition module 171 to determine the most recent time $t_0$ for which $T_{outlet}$ and/or $\chi_{outlet}$ did not exceed $T_{threshold}$ and/or $\chi_{threshold}$. Intensive control module 175 may calculate $t_{excess}$ by subtracting a time $t_1$ immediately after to (e.g., a time at which $T_{outlet}$ and/or $\chi_{outlet}$ first exceeded $T_{threshold}$ and/or $\chi_{threshold}$, a time of the next data measurement after $t_0$, etc.) from the current time $t_k$ (e.g., $t_{excess}=t_k-t_1$). Intensive control module 175 may compare the duration $t_{excess}$ with a threshold time value $t_{threshold}$ stored in parameter storage module 173. If $t_{excess}$ exceeds $t_{threshold}$ (e.g., $t_{excess}>t_{threshold}$), intensive control module 175 may activate parallel compressor 36, 136, or 236.

Upon activating the parallel compressor, intensive control module 175 may operate gas bypass valve 8 and parallel compressor 36, 136, or 236 substantially as described with reference to extensive control module 174. For example, intensive control module 175 may use a plurality of threshold pressure values (e.g., $P_{threshold_comp}$, $P_{threshold_valve}$) in determining whether to activate parallel compressor 36, 136, or 236 and/or open gas bypass valve 8. In some embodiments, $P_{threshold_valve}$ may initially be less than $P_{threshold_comp}$, resulting in pressure regulation using only gas bypass valve 8 when $P_{threshold_valve}<P_{rec}<P_{threshold_comp}$.

In some embodiments, intensive control module 175 adaptively adjusts the values for $P_{threshold_valve}$ and $P_{threshold_comp}$. Such adjustment may be based on the current operating conditions of $CO_2$ refrigeration system 100 (e.g., whether the parallel compressor is active, whether the gas bypass valve is open, the pressure within receiving tank 6, etc.). For example, intensive control module 175 may adjust the values for $P_{threshold_valve}$ and $P_{threshold_comp}$ upon activating parallel compressor 36, 136, or 236 (e.g., in response to in response to $T_{outlet}$ exceeding $T_{threshold}$, $t_{excess}$ exceeding $t_{threshold}$, $\chi_{outlet}$ exceeding $\chi_{threshold}$, etc.). The values may be adjusted such that $P_{threshold_valve}$ is greater than $P_{threshold_comp}$, resulting in pressure regulation using only the parallel compressor so long as $P_{threshold_comp}<P_{rec}<P_{threshold_valve}$.

In some embodiments, if $P_{rec}$ reaches a value above $P_{threshold_valve}$, intensive control module 175 may instruct the gas bypass valve 8 to open, thereby using both parallel compressor 36, 136, or 236 and gas bypass valve 8 to control $P_{rec}$. In some embodiments, if the parallel compressor becomes damaged, loses power, or otherwise becomes non-functional, gas bypass valve 8 may be used in place of parallel compressor 36, 136, 236, regardless of the pressure within $P_{rec}$. Advantageously, gas bypass valve 8 may function as a backup or safety pressure regulating mechanism in the event of a parallel compressor failure. In some embodiments, if $P_{rec}$ is reduced below $P_{threshold_comp}$, intensive control module 175 may instruct the parallel compressor to stop.

In some embodiments, intensive control module 175 adjusts the values for $P_{threshold_valve}$ and $P_{threshold_comp}$ upon deactivating parallel compressor 36, 136, or 236 (e.g., when $P_{rec}<P_{threshold_comp}$). Intensive control module 175 may adjust the threshold pressure values by swapping the values for $P_{threshold_valve}$ and $P_{threshold_comp}$ or otherwise adjusting the threshold values such that $P_{threshold_valve}<P_{threshold_comp}$. Accordingly, once the pressure within receiving tank 6 rises above $P_{threshold_valve}$ (e.g., $P_{threshold_valve}<P_{rec}<P_{threshold_comp}$), intensive control module 175 may instruct gas bypass valve 8 to open. Intensive control module 175 may continue to regulate the pressure within receiving tank 6 using only gas bypass valve 8. However, if $T_{outlet}>T_{threshold}$, $t_{excess}>t_{threshold}$, and/or $\chi_{outlet}>\chi_{threshold}$, intensive control module 175 may again activate parallel compressor 36, 136, or 236 and the cycle may be repeated.

Still referring to FIG. 7, memory 170 is shown to include a superheat control module 176. Superheat control module 176 may ensure that the $CO_2$ refrigerant flowing into a compressor (e.g., parallel compressors 36, 136, 236, MT compressors 14, LT compressors 24, etc.) contains no condensed $CO_2$ liquid, as the presence of condensed liquid flowing into a compressor could be detrimental to system performance. Superheat control module 176 may ensure that the $CO_2$ refrigerant flowing into the compressor (e.g., from the upstream suction side thereof) has a sufficient superheat (e.g., degrees above the temperature at which the $CO_2$ refrigerant begins to condense) to ensure that no liquid $CO_2$ is present. Superheat control module 176 may be used in combination with extensive control module 174, intensive control module 175, or as an independent control module.

In some embodiments, superheat control module 176 monitors a current temperature "$T_{suction}$" and/or pressure "$P_{suction}$" of the $CO_2$ refrigerant flowing into a compressor. The current temperature $T_{suction}$ and/or pressure $P_{suction}$ may be determined by data acquisition module 171 and stored in a local memory 170 of controller 106 or in a remote database accessible by controller 106. Superheat control module 176 may compare the current temperature $T_{suction}$ with a threshold temperature value "$T_{threshold}$" stored in parameter storage module 173. The threshold temperature value $T_{threshold}$ may be based on a temperature "$T_{condensation}$" at which the $CO_2$ refrigerant begins to condense into a liquid-vapor mixture at the current pressure $P_{suction}$. For example, $T_{threshold}$ may be a fixed number of degrees "$T_{superheat}$" above $T_{condensation}$ (e.g., $T_{threshold}=T_{condensation}+T_{superheat}$). In an exemplary embodiment, $T_{superheat}$ may be approximately 10K (Kelvin) or 10° C. In other embodiments, $T_{superheat}$ may be approximately 5K, approximately 15K, approximately 20K, or within a range between 5K and 20K. Superheat control module 176 may prevent activation of the compressor associated with the temperature measurement if $T_{suction}$ is less than $T_{threshold}$.

In some embodiments, superheat control module 176 monitors a current temperature "$T_{outlet}$" of the $CO_2$ refrigerant exiting gas cooler/condenser 2. Superheat control module 176 may ensure that the $CO_2$ refrigerant exiting gas cooler/condenser 2 has the ability to provide sufficient superheat (e.g., via heat exchanger 37, 137, 237) to the $CO_2$ refrigerant flowing into parallel compressor 36, 136, or 236. The current temperature $T_{outlet}$ may be determined by data acquisition module 171 and stored in a local memory 170 of controller 106 or in a remote database accessible by controller 106. Superheat control module 176 may compare the current temperature $T_{outlet}$ with a threshold temperature value "$T_{threshold_outlet}$" stored in parameter storage module 173. The threshold temperature value $T_{threshold_outlet}$ may be based on the temperature $T_{condensation}$ at which the $CO_2$ refrigerant begins to condense into a liquid-vapor mixture at the current pressure suction $P_{suction}$ for parallel compressor 36, 136, or 236. In some embodiments, the threshold temperature value $T_{threshold}$ may be based on an amount of heat predicted to transfer via heat exchanger 37, 137, or 237 (e.g., using a heat exchanger efficiency, a temperature differential between $T_{outlet}$ and $T_{suction}$, etc.). Superheat control module 176 may prevent activation of parallel compressor 36, 136, or 236 if $T_{outlet}$ is less than $T_{threshold}$.

Still referring to FIG. 7, memory 170 is shown to include a defrost control module 177. Defrost control module 177 may include functionality for defrosting one or more evaporators, fluid conduits, or other components of $CO_2$ refrigeration system 100. In some embodiments, the defrosting may be accomplished by circulating a hot gas through $CO_2$ refrigeration system 100. The hot gas may be the $CO_2$ refrigerant already circulating through $CO_2$ refrigeration system 100 if allowed to reach a temperature sufficient for defrosting. Exemplary hot gas defrost processes are described in detail in U.S. Pat. No. 8,011,192 titled "METHOD FOR DEFROSTING AN EVAPORATOR IN A REFRIGERATION CIRCUIT" and U.S. Provisional Application No. 61/562,162 titled "$CO_2$ REFRIGERATION SYSTEM WITH HOT GAS DEFROST." Both U.S. Pat. No. 8,011,192 and U.S. Provisional Application No. 61/562,162 are hereby incorporated by reference for their descriptions of such processes.

Defrost control module 177 may control the pressure $P_{rec}$ within receiving tank 6 during the defrosting process. In some embodiments, defrost control module 177 may reduce $P_{rec}$ from a normal operating pressure (e.g., of approximately 38 bar) to a defrosting pressure "$P_{rec_defrost}$" lower than the normal operating pressure. In some embodiments, $P_{rec_defrost}$ may be approximately 34 bar. In other embodiments, higher or lower defrosting pressures may be used.

During the hot gas defrosting process, defrost control module 177 may adjust the values for $P_{threshold_valve}$ and $P_{threshold_comp}$ used by extensive control module 174 and intensive control module 175. Defrost control module 177 may adjust the threshold pressure values by setting $P_{threshold_valve}$ to a valve defrosting pressure "$P_{valve_defrost}$" and by setting $P_{threshold_comp}$ to a compressor defrosting pressure "$P_{comp_defrost}$." In some embodiments, $P_{valve_defrost}$ and $P_{comp_defrost}$ may be less than $P_{threshold_valve}$ and $P_{threshold_comp}$ respectively. The threshold values set by defrost control module 177 may override the threshold values set by extensive control module 174 and intensive control module 175.

In some embodiments, $P_{valve_defrost}$ and $P_{comp_defrost}$ may be based on the non-defrosting pressure thresholds (e.g., $P_{threshold_valve}$ and $P_{threshold_comp}$) set by extensive control module 174 and intensive control module 175. For example defrost control module 177 may determine $P_{valve_defrost}$ by subtracting a fixed pressure offset "$P_{offset}$" from $P_{threshold_valve}$ (e.g., $P_{valve_defrost}=P_{threshold_valve}-P_{offset}$). Similarly, defrost control module 177 may determine $P_{comp_defrost}$ by subtracting a fixed pressure offset (e.g., $P_{offset}$ or a different pressure offset) from $P_{threshold_comp}$ (e.g., $P_{comp_defrost}=P_{threshold_comp}-P_{offset}$). The pressure thresholds set by defrost control module may be stored in parameter storage module 173 and used in place of $P_{threshold_valve}$ and $P_{threshold_comp}$ by extensive control module 174 and intensive control module 175.

Figure 8:
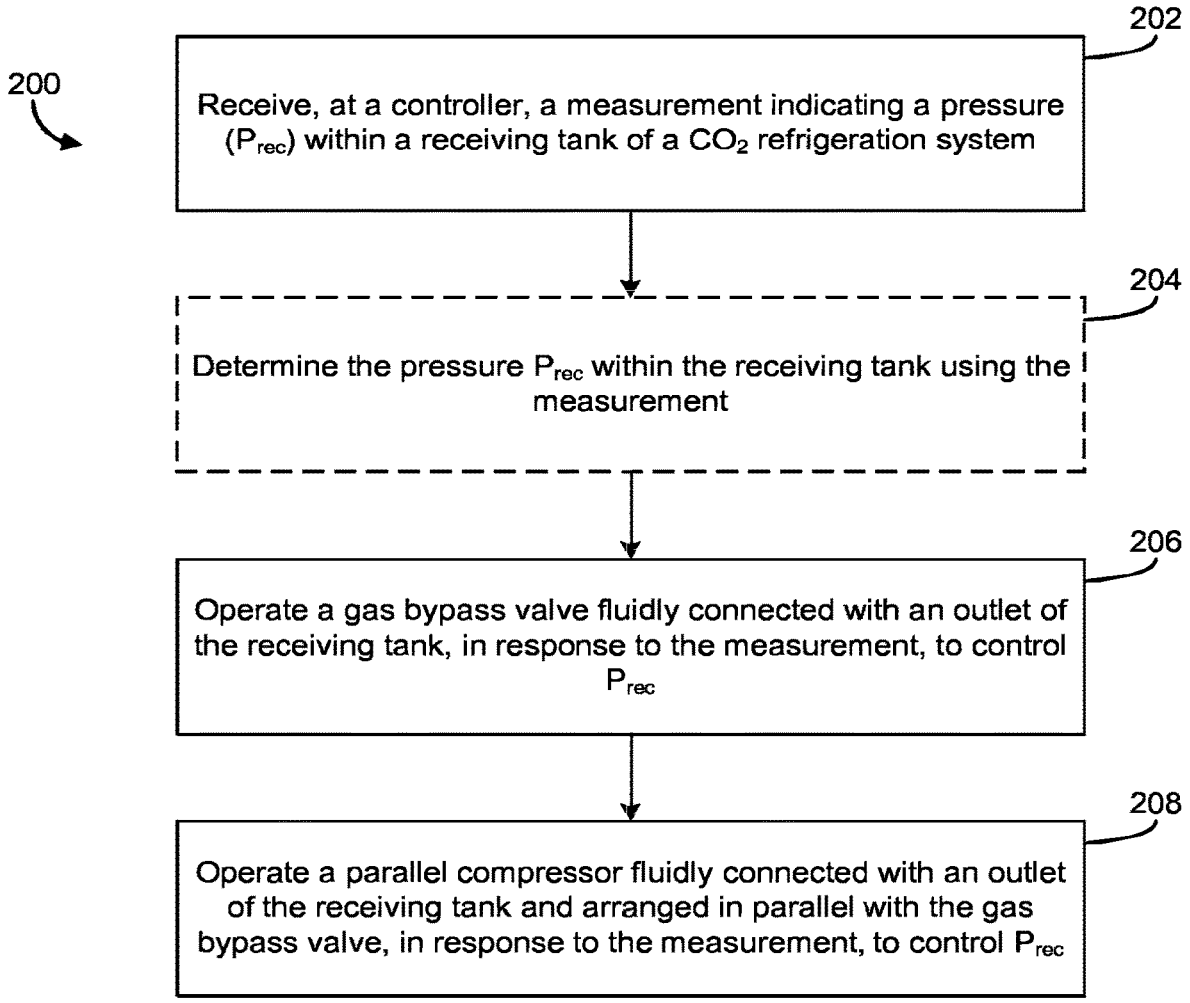
FIG. 8 is a flowchart of a process for controlling pressure in a $CO_2$ refrigeration system by operating both a gas bypass valve and a parallel compressor, according to an exemplary embodiment.

Referring now to FIG. 8, a flowchart of a process 200 for controlling pressure in a $CO_2$ refrigeration system is shown, according to an exemplary embodiment. Process 200 may be performed by controller 106 to control a pressure of the $CO_2$ refrigerant within receiving tank 6.

Process 200 is shown to include receiving, at a controller, a measurement indicating a pressure $P_{rec}$ within a receiving tank of a $CO_2$ refrigeration system (step 202). In some embodiments, the measurement is a pressure measurement obtained by a pressure sensor directly measuring pressure within the receiving tank. In other embodiments, the measurement may be a voltage measurement, a position measurement, or any other type of measurement from which the pressure $P_{rec}$ within the receiving tank may be determined (e.g., using a piezoelectric strain gauge, a Hall effect pressure sensor, etc.).

In some embodiments, process 200 includes determining the pressure $P_{rec}$ within the receiving tank using the measurement (step 204). Step 204 may be performed for embodiments in which the measurement received in step 202 is not a pressure value. Step 204 may include converting the measurement into a pressure value. The conversion may be accomplished using a conversion formula (e.g., voltage-to-pressure), a lookup table, by graphical interpolation, or any other conversion process. Step 202 may include converting an analog measurement to a digital pressure value. The digital pressure value may be stored in a local memory (e.g., magnetic disc, flash memory, RAM, etc.) of controller 106 or in a remote database accessible my controller 106.

Still referring to FIG. 8, process 200 is shown to include operating a gas bypass valve fluidly connected with an outlet of the receiving tank, in response to the measurement, to control the pressure $P_{rec}$ within the receiving tank (step 206). In some embodiments, the gas bypass valve is arranged in series with one or more compressors of the $CO_2$ refrigeration system (e.g., MT compressors 14, LT compressors 24, etc.).

Operating the gas bypass valve may include sending control signals to the gas bypass valve (e.g., from a controller performing process 200). Upon receiving an input signal from the controller, the gas bypass valve may move into an open, closed, or partially open position. The position of the gas bypass valve may correspond to a mass flow rate or a volume flow rate of $CO_2$ refrigerant through the gas bypass valve. In other words, the flow rate of the $CO_2$ refrigerant through the gas bypass valve may be a function of the valve position. In some embodiments, the gas bypass valve may be opened and closed smoothly (e.g., gradually, slowly, etc.). The gas bypass valve may be opened or closed using an actuator (e.g., electrical, pneumatic, magnetic, etc.) configured to receive input from the controller.

Still referring to FIG. 8, process 200 is shown to include operating a parallel compressor fluidly connected with an outlet of the receiving tank, in response to the measurement, to control the pressure $P_{rec}$ within the receiving tank (step 208). The parallel compressor may be arranged in parallel with both the gas bypass valve and the one or more compressors of the $CO_2$ refrigeration system. In some embodiments, the parallel compressor may be part of a flexible AC module (e.g., flexible AC modules 30, 130, 230) integrating air conditioning functionality with the $CO_2$ refrigeration system. An inlet of the parallel compressor (e.g., the upstream suction side) may be fluidly connected with an outlet of an AC evaporator. An outlet of the parallel compressor may be fluidly connected with a discharge line (e.g., fluid conduit 1) shared by both the parallel compressor and other compressors of the $CO_2$ refrigeration system.

Operating the parallel compressor may include sending control signals to the parallel compressor. The control signals may instruct the parallel compressor to activate or deactivate. In some embodiments, the control signals may instruct the parallel compressor to operate at a specified rate, speed, or power setting. In some embodiments, the parallel compressor may be operated by providing power to a compression circuit powering the parallel compressor. In some embodiments, multiple parallel compressors may be present and controlling the parallel compressors may include activating a subset thereof. In other embodiments, a single parallel compressor may be present. The parallel compressor and the gas bypass valve may be operated (e.g., activated, deactivated, opened, closed, etc.) in response to the pressure $P_{rec}$ within the receiving tank according to the rules provided in steps 206-218.

Advantageously, both the gas bypass valve and the parallel compressor may be fluidly connected with an outlet of the receiving tank. The gas bypass valve and the parallel compressor may provide parallel routes for releasing excess $CO_2$ vapor from the receiving tank. Each of the gas bypass valve and the parallel compressor may be operated to control the pressure of the $CO_2$ refrigerant within the receiving tank. In some embodiments, the gas bypass valve and the parallel compressor may be operated using a feedback control process (e.g., PI control, PID control, model predictive control, pattern recognition adaptive control, etc.). The gas bypass valve and the parallel compressor may be operated to achieve a desired pressure (e.g., a pressure setpoint) within the receiving tank or to maintain the pressure $P_{rec}$ within the receiving tank within a desired range. Detailed processes for operating the gas bypass valve and parallel compressor are described with reference to FIGS. 9-11.

Figure 9:
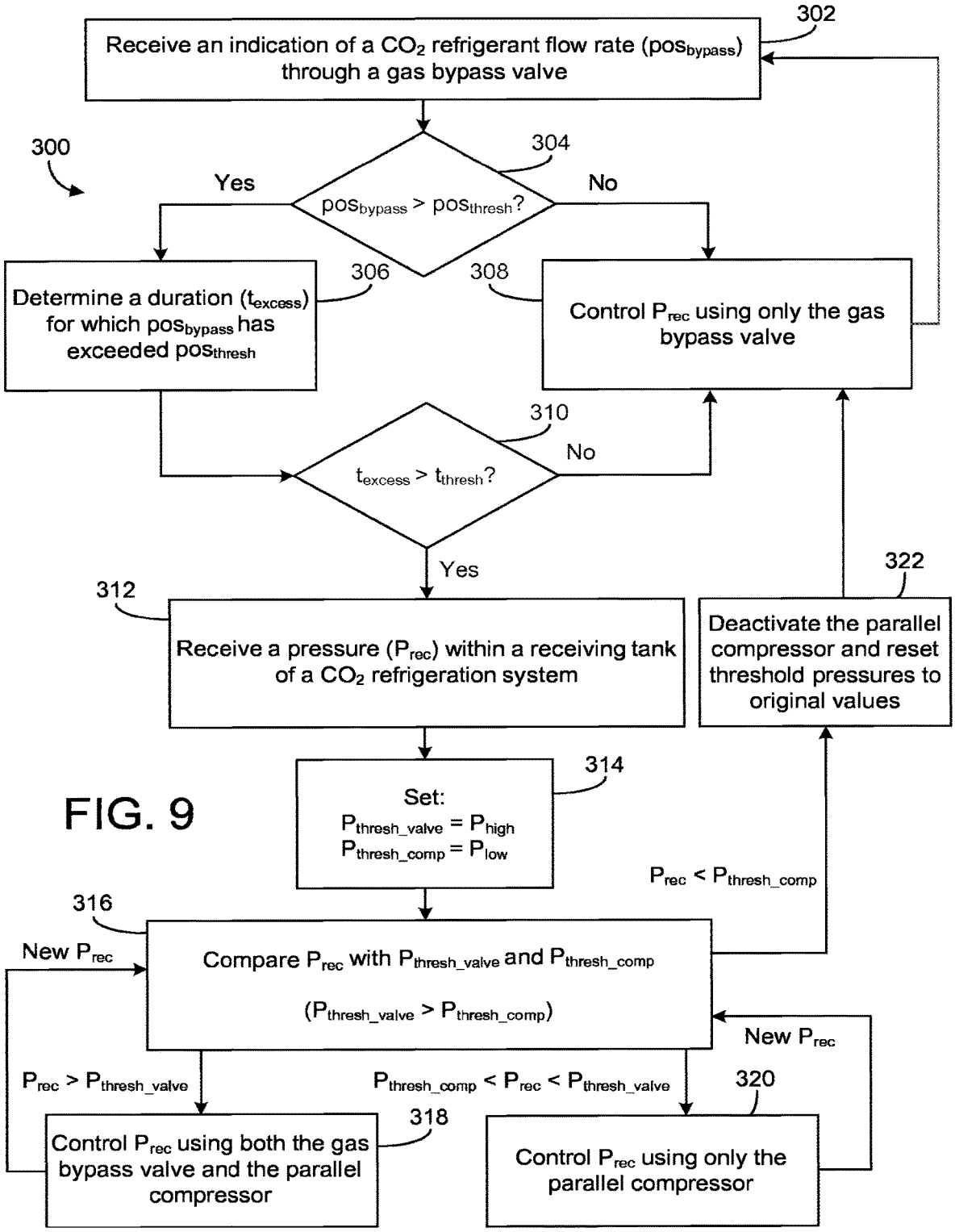
FIG. 9 is a flowchart of a process for operating both the gas bypass valve and parallel compressor to control pressure in a $CO_2$ refrigeration system based on an extensive property of the $CO_2$ refrigerant, according to an exemplary embodiment.

Referring now to FIG. 9, a flowchart of a process 300 for operating a gas bypass valve and a parallel compressor to control pressure in a $CO_2$ refrigeration system is shown, according to an exemplary embodiment. Process 300 may be performed by extensive control module 174 to control a pressure of the $CO_2$ refrigerant within receiving tank 6. In some embodiments, process 300 uses an extensive property of $CO_2$ refrigeration system 100 as a basis for pressure control. For example, process 300 may use the volume flow rate or mass flow rate of $CO_2$ refrigerant through the gas bypass valve (e.g., gas bypass valve 8) as a basis for activating or deactivating the parallel compressor (e.g., parallel compressor 36, 136, or 236) or for opening or closing the gas bypass valve.

Process 300 is shown to include receiving an indication of a $CO_2$ refrigerant flow rate through a gas bypass valve (step 302). In some embodiments, process 300 uses the position of the gas bypass valve $pos_{bypass}$ (e.g., 10% open, 40% open, etc.) as an indication of mass flow rate or volume flow rate as such quantities may be proportional or otherwise related. For example, step 302 may include monitoring or receiving a current position $pos_{bypass}$ of the gas bypass valve. The current position $pos_{bypass}$ may be received from a data acquisition module (e.g., module 171) of the control system, retrieved from a local or remote database, or received from any other source.

Still referring to FIG. 9, process 300 is shown to include comparing the indication of the $CO_2$ refrigerant flow rate $pos_{bypass}$ with a threshold value $pos_{thresh}$ (step 304). In some embodiments, threshold value $pos_{thresh}$ is a threshold position for the gas bypass valve. The threshold value $pos_{thresh}$ may be stored in a local memory of the control system (e.g., parameter storage module 173) and retrieved during step 304. Threshold value $pos_{thresh}$ may be specified by a user, received from another automated process, or determined automatically based on a history of past data measurements. In an exemplary embodiment, $pos_{thresh}$ may be a valve position of approximately 15% open. However, in other embodiments, various other valve positions or valve position ranges may be used for $pos_{thresh}$ (e.g., 10% open, 20% open, between 5% open and 30% open, etc.).

Still referring to FIG. 9, process 300 is shown to include controlling the pressure $P_{rec}$ within the receiving tank using only the gas bypass valve (step 308). Step 308 may be performed in response to a determination (e.g., in step 304) that the indication of $CO_2$ refrigerant flow rate through the gas bypass valve does not exceed the threshold value (e.g., $pos_{bypass} \leq pos_{thresh}$). Controlling $P_{rec}$ using only the gas bypass valve may include deactivating the parallel compressor, preventing the parallel compressor from activating, or not activating the parallel compressor. In step 308, only one of the two potential parallel paths (e.g., the path including the gas bypass valve) may be open for $CO_2$ vapor flow from the receiving tank. The other parallel path (e.g., the path including the parallel compressor) may be closed. Steps 302, 304, and 308 may be repeated each time a new indication of $CO_2$ refrigerant flow rate $pos_{bypass}$ is received.

Still referring to FIG. 9, process 300 is shown to include determining a duration $t_{excess}$ for which the current position $pos_{bypass}$ has exceeded $pos_{thresh}$ (step 306). Step 306 may be performed in response to a determination (e.g., in step 304) that the indication of $CO_2$ refrigerant flow rate through the gas bypass valve exceeds the threshold value (e.g., $pos_{bypass} > pos_{thresh}$). In some embodiments, step 306 may be accomplished by determining a most recent time $t_0$ for which $pos_{bypass}$ did not exceed $pos_{thresh}$ (e.g., using timestamps recorded with each data value by data acquisition module 171). $t_{excess}$ may be calculated by subtracting a time $t_1$ immediately after $t_0$ from the current time $t_k$ (e.g., $t_{excess} = t_k -$ $t_1$). Time $t_1$ may be a time at which $pos_{bypass}$ first exceeded $pos_{thresh}$ after $t_0$, a time of the next data value following $t_0$, etc.

Process 300 is shown to further include comparing the duration $t_{excess}$ with a threshold time value $t_{threshold}$ (step 310). The threshold time value $t_{threshold}$ may be an upper threshold on the duration $t_{excess}$. Threshold time value $t_{threshold}$ may define a maximum time that the indication of $CO_2$ refrigerant through the gas bypass valve $pos_{bypass}$ can exceed the threshold value $pos_{thresh}$ before ceasing to control $P_{rec}$ using only the gas bypass valve. In some embodiments, the threshold time parameter may be stored in parameter storage module 173. If the comparison performed in step 310 reveals that the duration of excess $t_{excess}$ does not the threshold time value (e.g., $t_{excess} \leq t_{threshold}$), process 300 may involve controlling $P_{rec}$ using only the gas bypass valve (step 308). However, if the comparison reveals that $t_{excess} > t_{threshold}$, process 300 may proceed by performing step 312.

Still referring to FIG. 9, process 300 is shown to include receiving a pressure $P_{rec}$ within a receiving tank of a $CO_2$ refrigeration system (step 312). Step 312 may be performed in response to a determination (e.g., in step 310) that the excess time duration exceeds the time threshold (e.g., $t_{excess} > t_{threshold}$). The pressure $P_{rec}$ may be received from a pressure sensor directly measuring pressure within the receiving tank or calculated from one or more measured values, as previously described with reference to FIG. 8

Process 300 is shown to further include setting values for a gas bypass valve threshold pressure $P_{thresh_valve}$ and a parallel compressor threshold pressure $P_{thresh_comp}$ (step 314). $P_{thresh_valve}$ and $P_{thresh_comp}$ may define threshold pressures for the gas bypass valve and the parallel compressor respectively. In some embodiments, $P_{thresh_valve}$ may have an initial value less than $P_{thresh_comp}$ (e.g., $P_{thresh_valve} < P_{thresh_comp}$) throughout the duration of steps 302-312. For example, $P_m$ may initially have a value of approximately 40 bar and $P_{thresh_comp}$ may initially have a value of approximately 42 bar throughout steps 302-312. However, these numerical values are intended to be illustrative and non-limiting. In other embodiments, $P_{thresh_valve}$ and $P_{thresh_comp}$ may have higher or lower initial values. In some embodiments, $P_{thresh_valve}$ may have an initial value of approximately 30 bar. In some embodiments, $P_{thresh_valve}$ may have an initial value within a range from 30 bar to 40 bar. The initial value of $P_{thresh_valve}$ may be equal to a setpoint pressure $P_{setpoint}$ for receiving tank 6 or based on the pressure setpoint (e.g., $P_{setpoint}$+10 bar, $P_{setpoint}$+30 bar, etc.).

In some embodiments, setting the threshold pressure values in step 314 includes setting $P_{thresh_valve}$ to a high threshold pressure $P_{high}$ and setting $P_{thresh_comp}$ to a low threshold pressure $P_{low}$, wherein $P_{high}$ is greater than $P_{low}$. In some embodiments, step 314 may be accomplished by swapping the values for $P_{thresh_valve}$ and $P_{thresh_comp}$ (e.g., such that $P_{thresh_valve}$ is adjusted to approximately 42 bar and $P_{thresh_comp}$ is adjusted to approximately 40 bar). However, in other embodiments, different values for $P_{high}$ and $P_{low}$ may be used. In some embodiments, both of $P_{thresh_valve}$ and $P_{thresh_comp}$ may be adjusted. In other embodiments, only one of $P_{thresh_valve}$ and $P_{thresh_comp}$ may be adjusted.

Still referring to FIG. 9, process 300 is shown to include comparing the pressure $P_{rec}$ within the receiving tank with the gas bypass valve threshold pressure $P_{thresh_valve}$ and the parallel compressor threshold pressure $P_{thresh_comp}$ (step 316). If the result of the comparison reveals that $P_{rec} > P_{thresh_valve}$, the pressure within the receiving tank may be controlled using both the gas bypass valve and the parallel compressor (e.g., step 318). Steps 316-318 may be repeated (e.g., each time a new pressure measurement $P_{rec}$ is received) until $P_{rec}$ does not exceed the adjusted value (e.g., $P_{high}$) for $P_{thresh_valve}$.

Process 300 is shown to further include controlling $P_{rec}$ using only the parallel compressor (step 320). Step 320 may be performed in response to a determination (e.g., in step 316) that the pressure within the receiving tank is between the parallel compressor threshold pressure and the gas bypass valve threshold pressure (e.g., $P_{thresh_comp} < P_{rec} < P_{thresh_valve}$). Controlling $P_{rec}$ using only the parallel compressor may be a more energy efficient alternative to using only the gas bypass valve is used to control $P_{rec}$. Steps 316 and 320 may be repeated (e.g., each time a new pressure measurement $P_{rec}$ is received) until $P_{rec}$ is no longer within the range between $P_{thresh_comp}$ and $P_{thresh_valve}$.

Still referring to FIG. 9, process 300 is shown to include deactivating the parallel compressor and resetting the threshold pressures to their original values (step 322). Step 322 may be performed in response to a determination (e.g., in step 316) that the pressure within the receiving tank is less than the parallel compressor threshold pressure (e.g., $P_{rec} < P_{thresh_comp}$). Resetting the threshold pressures may cause $P_{thresh_valve}$ and $P_{thresh_comp}$ to revert to their original values (e.g., approximately 40 bar and approximately 42 bar respectively).

After resetting the threshold pressures, process 300 is shown to include controlling $P_{rec}$ once again using only the gas bypass valve (step 308). Advantageously, using only the gas bypass valve to control $P_{rec}$ may prevent the parallel compressor from rapidly activating and deactivating, thereby conserving energy and prolonging the life of the parallel compressor. Steps 302, 304, and 308 may be repeated each time a new indication of $CO_2$ refrigerant flow rate $pos_{bypass}$ is received.

In some embodiments, process 300 may involve monitoring a current temperature $T_{suction}$ and/or pressure $P_{suction}$ of the $CO_2$ refrigerant flowing into a compressor. $T_{suction}$ and/or $P_{suction}$ may be monitored to ensure that the $CO_2$ refrigerant flowing into a compressor (e.g., parallel compressors 36, 136, 236, MT compressors 14, LT compressors 24, etc.) contains no condensed $CO_2$ liquid.

Process 300 may include comparing the current temperature $T_{suction}$ with a threshold temperature value $T_{threshold}$. In some embodiments, the threshold temperature value $T_{threshold}$ may be stored in parameter storage module 173. The threshold temperature value $T_{threshold}$ may be based on a temperature $T_{condensation}$ at which the $CO_2$ refrigerant begins to condense into a liquid-vapor mixture at the current pressure $P_{suction}$. For example, $T_{threshold}$ may be a fixed number of degrees $T_{superheat}$ above $T_{condensation}$ (e.g., $T_{threshold} = T_{condensation} + T_{superheat}$). In an exemplary embodiment, $T_{superheat}$ may be approximately 10K (Kelvin) or 10° C. In other embodiments, $T_{superheat}$ may be approximately 5K, approximately 15K, approximately 20K, within a range between 5K and 20K, or have any other temperature value. In some embodiments, the parallel compressor may be deactivated or may not be activated (e.g., in steps 318 and 320) if $T_{suction}$ is less than $T_{threshold}$.

In some embodiments, process 300 includes monitoring a current temperature $T_{outlet}$ of the $CO_2$ refrigerant exiting gas cooler/condenser 2. The temperature $T_{outlet}$ may be monitored to ensure that the $CO_2$ refrigerant exiting gas cooler/condenser 2 has the ability to provide sufficient superheat (e.g., via heat exchanger 37, 137, 237) to the $CO_2$ refrigerant flowing into the parallel compressor. The current temperature $T_{outlet}$ may be determined by data acquisition module 171 and stored in a local memory 170 of controller 106 or in a remote database accessible by controller 106.

Process 300 may involve comparing the current temperature $T_{outlet}$ with a threshold temperature value $T_{threshold_outlet}$. The threshold temperature value $T_{threshold_outlet}$ may be based on the temperature $T_{condensation}$ at which the $CO_2$ refrigerant begins to condense into a liquid-vapor mixture at the current pressure suction $P_{suction}$ for the parallel compressor In some embodiments, the threshold temperature value $T_{threshold}$ may be based on an amount of heat predicted to transfer via heat exchanger 37, 137, or 237 (e.g., using a heat exchanger efficiency, a temperature differential between $T_{outlet}$ and $T_{suction}$ etc.). In some embodiments, the parallel compressor may be deactivated or may not be activated (e.g., in steps 318 and 320) if $T_{outlet}$ is less than $T_{threshold}$.

Figure 10:
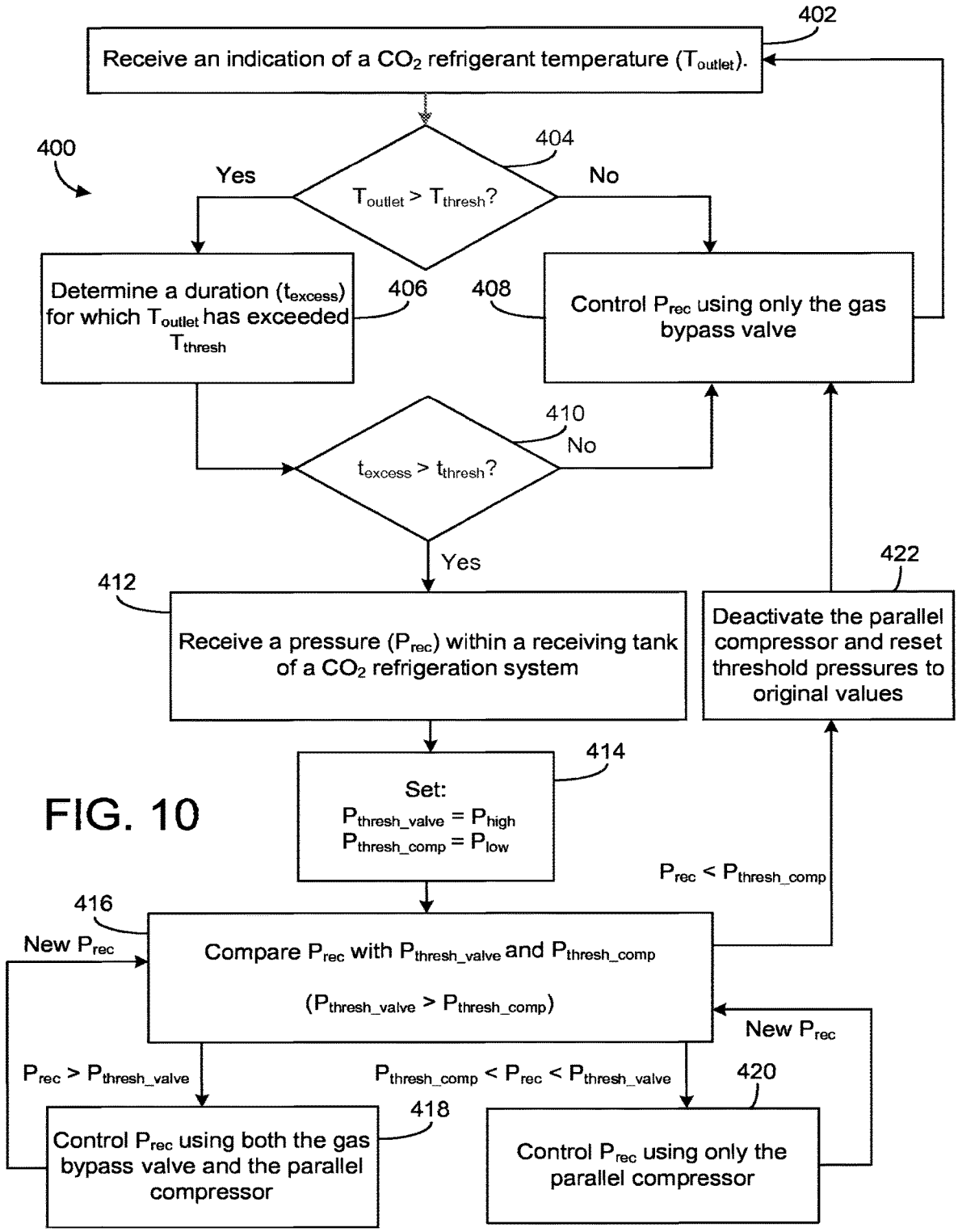
FIG. 10 is a flowchart of a process for operating both the gas bypass valve and parallel compressor to control pressure in a $CO_2$ refrigeration system based on an intensive property of the $CO_2$ refrigerant, according to an exemplary embodiment.

Referring now to FIG. 10, a flowchart of a process 400 for operating a gas bypass valve and a parallel compressor to control a pressure within a receiving tank of a $CO_2$ refrigeration system is shown, according to another exemplary embodiment. Process 400 may be performed intensive control module 175 to control a pressure $P_{rec}$ within receiving tank 6. Process 400 may be defined as an "intensive" control process because an intensive property of the $CO_2$ refrigerant (e.g., temperature, enthalpy, pressure, internal energy, etc.) may be used as a basis for activating or deactivating the parallel compressor or for opening or closing the gas bypass valve. The intensive property may be measured or calculated from one or more measured quantities.

Process 400 is shown to include receiving an indication of $CO_2$ refrigerant temperature (step 402). In some embodiments, the indication of $CO_2$ refrigerant temperature is a current temperature $T_{outlet}$ of the $CO_2$ refrigerant at the outlet of gas cooler/condenser 2. In some embodiments, the $CO_2$ refrigerant exiting gas the cooler/condenser may be a partially condensed mixture of $CO_2$ vapor and $CO_2$ liquid. In such embodiments, step 402 may include determining or receiving a thermodynamic quality $\chi_{outlet}$ of the $CO_2$ refrigerant mixture at the outlet of the gas cooler/condenser. The outlet quality $\chi_{outlet}$ may be a mass fraction of the mixture exiting the gas cooler/condenser that is $CO_2$ vapor $$\left(\text{e.g., } \chi_{outlet} = \frac{m_{vapor}}{m_{total}}\right).$$

The current temperature $T_{outlet}$ and the current quality $\chi_{outlet}$ may be received from a data acquisition module (e.g., module 171) of the control system, retrieved from a local or remote database, or received from any other source.

Still referring to FIG. 10, process 400 is shown to include comparing the indication of the $CO_2$ refrigerant temperature $T_{outlet}$ with a threshold value $T_{thresh}$ (step 404). In some embodiments, threshold value $T_{thresh}$ may be a threshold temperature for the $CO_2$ refrigerant at the outlet of gas cooler/condenser 2. The threshold value $T_{thresh}$ may be stored in a local memory of the control system (e.g., parameter storage module 173) and retrieved during step 404. Threshold value $T_{thresh}$ may be specified by a user, received from another automated process, or determined automatically based on a history of past data measurements. In an exemplary embodiment, $T_{thresh}$ may be a temperature of approximately 13° C. However, in other embodiments, other values or ranges of values for $T_{threshold}$ may be used (e.g., 0° C., 5° C., 20° C., between 10° C. and 20° C., etc.).

In some embodiments, step 404 may include comparing the current outlet quality $\chi_{outlet}$ with a threshold quality value $\chi_{threshold}$. In an exemplary embodiment, the quality threshold $\chi_{threshold}$ may be approximately 30%. In other embodiments, higher or lower values for $\chi_{threshold}$ may be used (e.g., 10%, 20%, 40%, 50%, etc.)

Still referring to FIG. 10, process 400 is shown to include controlling the pressure $P_{rec}$ within the receiving tank using only the gas bypass valve (step 408). Step 408 may be performed in response to a determination (e.g., in step 404) that the indication of the $CO_2$ refrigerant temperature does not exceed the threshold value (e.g., $T_{outlet} \leq T_{thresh}$). In some embodiments, step 408 may be performed in response to a determination that the outlet quality does not exceed the quality threshold (e.g., $\chi_{outlet} \leq \chi_{threshold}$).

Controlling $P_{rec}$ using only the gas bypass valve may include deactivating the parallel compressor, preventing the parallel compressor from activating, or not activating the parallel compressor. In step 408, only one of the two potential parallel paths (e.g., the path including the gas bypass valve) may be open for $CO_2$ vapor flow from the receiving tank. The other parallel path (e.g., the path including the parallel compressor) may be closed. Steps 402, 404, and 408 may be repeated each time a new indication of $CO_2$ refrigerant temperature $T_{outlet}$ is received.

Still referring to FIG. 10, process 400 is shown to include determining a duration $t_{excess}$ for which the current temperature $T_{outlet}$ has exceeded the threshold value $T_{threshold}$ (step 406). In some embodiments, step 406 includes determining a duration for which the current outlet quality $\chi_{outlet}$ has exceeded the outlet threshold $\chi_{threshold}$. Step 406 may be performed in response to a determination (e.g., in step 404) that the current temperature and/or quality exceeds the threshold temperature and/or quality (e.g., $T_{outlet} > T_{thresh}$, $\chi_{outlet} > \chi_{threshold}$). In some embodiments, step 406 may be accomplished by determining a most recent time $t_0$ for which $T_{outlet}$ and/or $\chi_{outlet}$ did not exceed $T_{threshold}$ and/or $\chi_{threshold}$ (e.g., using timestamps recorded with each data value by data acquisition module 171). $t_{excess}$ may be calculated by subtracting a time $t_1$ immediately after $t_0$ (e.g., a time at which $T_{outlet}$ and/or $\chi_{outlet}$ first exceeded $T_{threshold}$ and/or $\chi$threshold, a time of the next data value following $t_0$, etc.) from the current time $t_k$ (e.g., $t_{excess} = t_k - t_1$).

Process 400 is shown to further include comparing the duration $t_{excess}$ with a threshold time value $t_{threshold}$ (step 410). The threshold time value $t_{threshold}$ may be an upper threshold on the duration $t_{excess}$. Threshold time value $t_{threshold}$ may define a maximum time that the indication of $CO_2$ refrigerant temperature $T_{outlet}$ can exceed the threshold value $T_{threshold}$ before ceasing to control $P_{rec}$ using only the gas bypass valve. In some embodiments, the threshold time parameter may be stored in parameter storage module 173. If the comparison performed in step 410 reveals that $t_{excess} \leq t_{threshold}$, process 400 may involve controlling $P_{rec}$ using only the gas bypass valve (step 408). However, if the comparison reveals that $t_{excess} > t_{threshold}$, process 400 may proceed by performing step 412.

Still referring to FIG. 10, process 400 is shown to include receiving a pressure $P_{rec}$ within a receiving tank of a $CO_2$ refrigeration system (step 412). Step 412 may be performed in response to a determination (e.g., in step 410) that the excess time duration exceeds the time threshold (e.g., $t_{excess} > t_{threshold}$). The pressure $P_{rec}$ may be received from a pressure sensor directly measuring pressure within the receiving tank or calculated from one or more measured values, as previously described with reference to FIG. 8

Process 400 is shown to further include setting values for a gas bypass valve threshold pressure $P_{thresh_valve}$ and a parallel compressor threshold pressure $P_{thresh_comp}$ (step 414). $P_{thresh_valve}$ and $P_{thresh_comp}$ may define threshold pressures for the gas bypass valve and the parallel compressor respectively. In some embodiments, $P_{thresh_valve}$ may have an initial value less than $P_{thresh_comp}$ (e.g., $P_{thresh_valve}<P_{thresh_comp}$) throughout the duration of steps 402-412. For example, $P_{thresh_valve}$ may have an initial value of approximately 40 bar and $P_{thresh_comp}$ may have an initial value of approximately 42 bar throughout steps 402-412. However, these numerical values are intended to be illustrative and non-limiting. In other embodiments, $P_{thresh_valve}$ and $P_{thresh_comp}$ may have higher or lower initial values.

In some embodiments, setting the threshold pressure values in step 414 includes setting $P_{thresh_valve}$ to a high threshold pressure $P_{high}$ and setting $P_{thresh_comp}$ to a low threshold pressure $P_{low}$, wherein $P_{high}$ is greater than $P_{low}$. In some embodiments, step 414 may be accomplished by swapping the values for $P_{thresh_valve}$ and $P_{thresh_comp}$ (e.g., such that $P_{thresh_valve}$ is adjusted to approximately 42 bar and $P_{thresh_comp}$ is adjusted to approximately 40 bar). However, in other embodiments, different values for $P_{high}$ and $P_{low}$ may be used.

Still referring to FIG. 10, process 400 is shown to include comparing $P_{rec}$ with $P_{thresh_valve}$ and $P_{thresh_comp}$ (step 416). If the result of the comparison reveals that $P_{rec}>P_{thresh_valve}$, the pressure within the receiving tank may be controlled using both the gas bypass valve and the parallel compressor (e.g., step 418). Steps 416-418 may be repeated (e.g., each time a new pressure measurement $P_{rec}$ is received) until $P_{rec}$ does not exceed the adjusted value (e.g., $P_{high}$) for $P_{thresh_valve}$.

Process 400 is shown to further include controlling $P_{rec}$ using only the parallel compressor (step 420). Step 420 may be performed in response to a determination (e.g., in step 416) that the pressure within the receiving tank is between the parallel compressor threshold pressure and the gas bypass valve threshold pressure (e.g., $P_{thresh_comp}<P_{rec}<P_{thresh_valve}$). Controlling $P_{rec}$ using only the parallel compressor may be a more energy efficient alternative to using only the gas bypass valve is used to control $P_{rec}$. Steps 416 and 420 may be repeated (e.g., each time a new pressure measurement $P_{rec}$ is received) until $P_{rec}$ is no longer within the range between $P_{thresh_comp}$ and $P_{thresh_valve}$.

Still referring to FIG. 10, process 400 is shown to include deactivating the parallel compressor and resetting the threshold pressures to their original values (step 422). Step 422 may be performed in response to a determination (e.g., in step 416) that the pressure within the receiving tank is less than the parallel compressor threshold pressure (e.g., $P_{rec}<P_{thresh_comp}$). Resetting the threshold pressures may cause $P_{thresh_valve}$ and $P_{thresh_comp}$ to revert to their original values (e.g., approximately 40 bar and approximately 42 bar respectively).

After resetting the threshold pressures, process 400 is shown to include controlling $P_{rec}$ once again using only the gas bypass valve (step 408). Advantageously, using only the gas bypass valve to control $P_{rec}$ may prevent the parallel compressor from rapidly activating and deactivating, thereby conserving energy and prolonging the life of the parallel compressor. Steps 402, 404, and 408 may be repeated each time a new indication of $CO_2$ refrigerant temperature $T_{outlet}$ is received.

Figure 11:
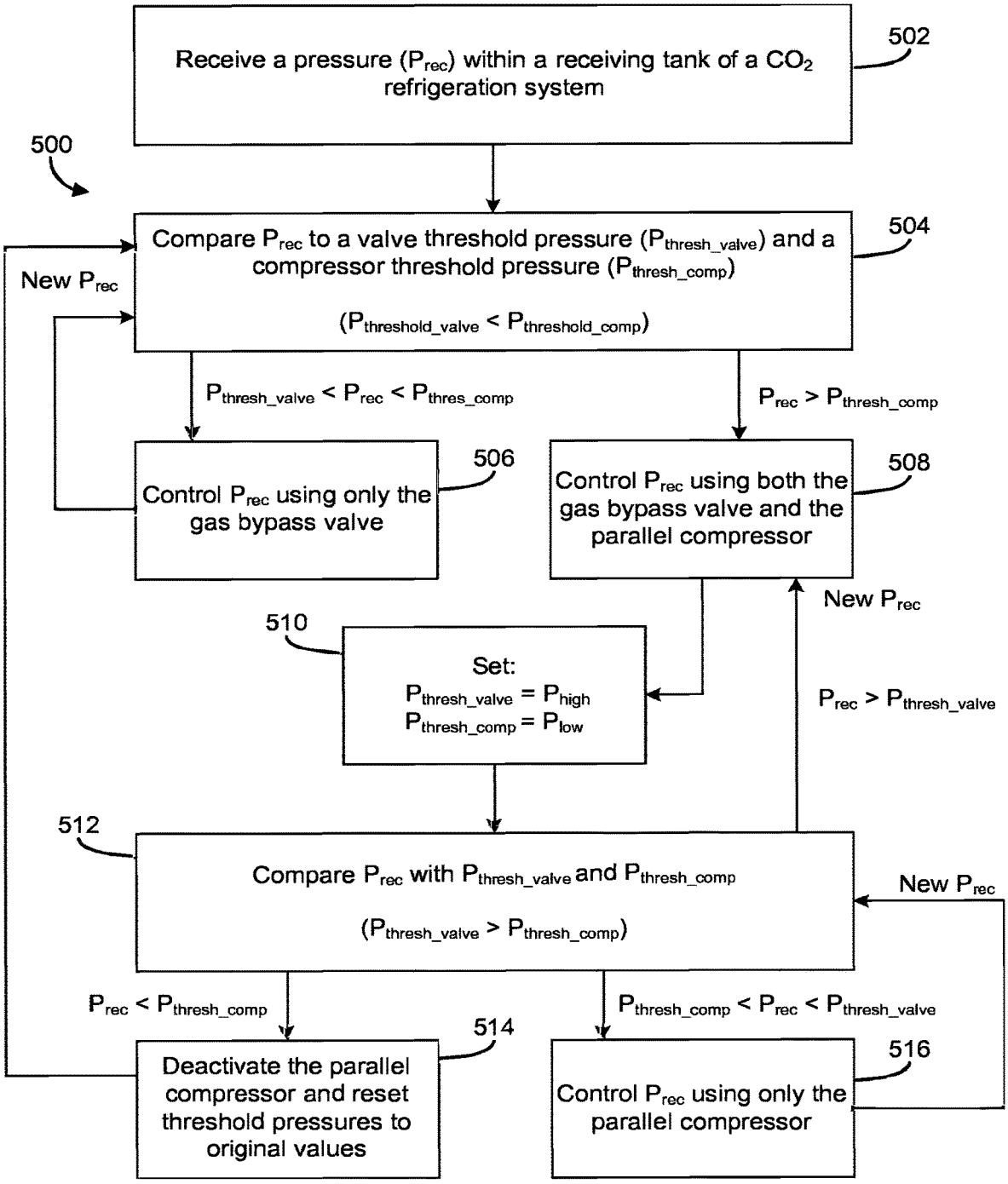
FIG. 11 is a flowchart of another process for operating both the gas bypass valve and parallel compressor to control pressure in a $CO_2$ refrigeration system, according to an exemplary embodiment.

Referring now to FIG. 11, a flowchart of another process 500 for operating a gas bypass valve and a parallel compressor to control a pressure within a receiving tank of a $CO_2$ refrigeration system is shown, according to exemplary embodiment. Process 500 may be performed by controller 106 to control the pressure within receiving tank 6.

Process 500 is shown to include receiving a pressure $P_{rec}$ within a receiving tank of a $CO_2$ refrigeration system (step 502). The pressure $P_{rec}$ may be received from a pressure sensor directly measuring pressure within the receiving tank or calculated from one or more measured values, as previously described with reference to FIG. 8.

Still referring to FIG. 11, process 500 is shown to include comparing $P_{rec}$ to a valve threshold pressure $P_{thresh_valve}$ and a compressor threshold pressure $P_{thresh_comp}$ (step 504). $P_{thresh_valve}$ and $P_{thresh_comp}$ may define threshold pressures for the gas bypass valve and the parallel compressor respectively. In some embodiments, $P_{thresh_valve}$ may be initially less than $P_{thresh_comp}$ (e.g., $P_{thresh_valve}<P_{thresh_comp}$). For example, $P_{thresh_valve}$ may be set to a pressure of approximately 40 bar and $P_{thresh_comp}$ may be set to a pressure of approximately 42 bar. However, these numerical values are intended to be illustrative and non-limiting. In other embodiments, $P_{thresh_valve}$ and $P_{thresh_comp}$ may have higher or lower initial values.

The threshold pressures $P_{thresh_valve}$ and $P_{thresh_comp}$ may define pressures at which the gas bypass valve and the parallel compressor are opened and/or activated to control the pressure $P_{rec}$ within the receiving tank. In some embodiments, $P_{thresh_valve}$ and $P_{thresh_comp}$ define upper threshold pressures. For example, if $P_{rec}$ is less than both $P_{thresh_valve}$ and $P_{thresh_comp}$, the controller may instruct the gas bypass valve to close and/or instruct the parallel compressor to deactivate. Closing the gas bypass valve and deactivating the parallel compressor may close each of the parallel paths by which excess $CO_2$ vapor can be released from the receiving tank. Closing such paths may cause the pressure $P_{rec}$ to rise as a result of continued operation of the other compressors of the $CO_2$ refrigeration system (e.g., MT compressors 14, LT compressors 24, etc.). However, if the comparison conducted in step 506 determines that $P_{rec}$ is not less than both $P_{thresh_valve}$ and $P_{thresh_comp}$, different control actions (e.g., step 506 or step 508) may be taken.

Still referring to FIG. 11, process 500 is shown to include controlling $P_{rec}$ using only the gas bypass valve (step 506). Step 506 may be performed in response to a determination (e.g., in step 504) that the pressure within the receiving tank is between the valve threshold pressure and the parallel compressor threshold pressure (e.g., $P_{thresh_valve}<P_{rec}<P_{thresh_comp}$). When $P_{rec}$ is determined to be within this range, the gas bypass valve may be opened and closed as necessary to maintain $P_{rec}$ at a desired pressure because $P_{rec}$ exceeds $P_{thresh_valve}$. However, the parallel compressor may remain inactive because $P_{rec}$ does not exceed $P_{thresh_comp}$. Steps 504 and 506 may be repeated (e.g., each time a new pressure measurement $P_{rec}$ is received) until $P_{rec}$ exceeds $P_{thresh_comp}$.

Still referring to FIG. 11, process 500 is shown to include controlling $P_{rec}$ using both the gas bypass valve and the parallel compressor (step 508). Step 508 may be performed in response to a determination (e.g., in step 504) that the pressure within the receiving tank exceeds the parallel compressor threshold pressure (e.g., $P_{rec}>P_{thresh_comp}$). When $P_{rec}$ is determined to exceed $P_{thresh_comp}$, the parallel compressor may be activated to control the pressure $P_{rec}$ within the receiving tank. In some embodiments, $P_{thresh_valve}$ may initially be less than $P_{thresh_comp}$ (e.g., $P_{thresh_valve}<P_{thresh_comp}$). Therefore, when $P_{rec}$ exceeds $P_{thresh_comp}$, $P_{rec}$ may also exceed $P_{thresh_valve}$ (e.g., $P_{thresh_valve}<P_{thresh_comp}<P_{rec}$). When the pressure within the receiving tank exceeds both the valve threshold pressure and the parallel compressor threshold pressure, both the gas bypass valve and the parallel compressor may be used to control $P_{rec}$.

Still referring to FIG. 11, process 500 is shown to include adjusting the values for the gas bypass valve threshold pressure $P_{thresh_valve}$ and the parallel compressor threshold pressure $P_{thresh_comp}$ (step 510). Step 510 may be performed in response to a determination (e.g., in step 504) that the pressure within the receiving tank exceeds the parallel compressor threshold pressure (e.g., $P_{rec}>P_{thresh_comp}$). In some embodiments, adjusting the threshold pressure values includes setting $P_{thresh_valve}$ to a high threshold pressure $P_{high}$ and setting $P_{thresh_comp}$ to a low threshold pressure $P_{low}$, wherein $P_{high}$ is greater than $P_{low}$. In some embodiments, step 510 may be accomplished by swapping the values for $P_{thresh_valve}$ and $P_{thresh_comp}$ (e.g., such that $P_{thresh_valve}$ is adjusted to approximately 42 bar and $P_{thresh_comp}$ is adjusted to approximately 40 bar). However, in other embodiments, different values for $P_{high}$ and $P_{low}$ may be used. Advantageously, adjusting the threshold pressures may reconfigure the control system such that $P_{thresh_valve}$ is greater than $P_{thresh_comp}$.

Still referring to FIG. 11, process 500 is shown to include comparing $P_{rec}$ with $P_{thresh_valve}$ and $P_{thresh_comp}$ (step 512). Step 512 may be substantially equivalent to step 504. However, in step 512, $P_{thresh_valve}$ is greater than $P_{thresh_comp}$ as a result of the adjustment performed in step 510. If the result of the comparison in step 512 reveals that $P_{rec}>P_{thresh_valve}$, the pressure $P_{rec}$ within the receiving tank may be controlled using both the gas bypass valve and the parallel compressor (e.g., step 508). Steps 508-512 may be repeated (e.g., each time a new pressure measurement $P_{rec}$ is received) until $P_{rec}$ does not exceed the adjusted (e.g., higher) value for $P_{thresh_valve}$.

Process 500 is shown to include controlling $P_{rec}$ using only the parallel compressor (step 516). Step 516 may be performed in response to a determination (e.g., in step 512) that the pressure within the receiving tank is between the parallel compressor threshold pressure and the gas bypass valve threshold pressure (e.g., $P_{thresh_comp}<P_{rec}<P_{thresh_valve}$). Controlling $P_{rec}$ using only the parallel compressor may be a more energy efficient alternative to using only the gas bypass valve is used to control $P_{rec}$. Steps 516 and 512 may be repeated (e.g., each time a new pressure measurement $P_{rec}$ is received) until $P_{rec}$ is no longer within the range between $P_{thresh_comp}$ and $P_{thresh_valve}$.

Still referring to FIG. 11, process 500 is shown to include deactivating the parallel compressor and resetting the threshold pressures to their original values (step 514). Step 514 may be performed in response to a determination (e.g., in step 512) that the pressure within the receiving tank is less than the parallel compressor threshold pressure (e.g., $P_{rec}<P_{thresh_comp}$). Resetting the threshold pressures may cause $P_{thresh_valve}$ and $P_{thresh_comp}$ to revert to their original values (e.g., approximately 40 bar and approximately 42 bar respectively).

After resetting the threshold pressures, process 500 may be repeated iteratively, starting with step 504. Because $P_{thresh_valve}$ is now less than $P_{thresh_comp}$, once the pressure within the receiving tank rises above $P_{thresh_valve}$, $P_{rec}$ may be controlled once again using only the gas bypass valve (step 506). Advantageously, using only the gas bypass valve to control $P_{rec}$ may prevent the parallel compressor from rapidly activating and deactivating, thereby conserving energy and prolonging the life of the parallel compressor.

The construction and arrangement of the elements of the $CO_2$ refrigeration system and pressure control system as shown in the exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A system for controlling pressure in a CO2 refrigeration system having a receiving tank, a compressor, and a gas cooler/condenser, the system for controlling pressure comprising:

a gas bypass valve fluidly connected with an outlet of the receiving tank and arranged in series with the compressor;

a parallel compressor fluidly connected with the outlet of the receiving tank and arranged in parallel with both the gas bypass valve and the compressor; and a controller configured to:

receive an indication of a CO2 refrigerant flow rate through the gas bypass valve;

compare the indication of the CO2 refrigerant flow rate with a threshold value indicating a threshold flow rate through the gas bypass valve;

activate the parallel compressor in response to the indication of the CO2 refrigerant flow rate exceeding the threshold value;

compare the pressure within the receiving tank to a first threshold pressure and a second threshold pressure higher than the first threshold pressure;

increase the first threshold pressure to a first adjusted threshold pressure higher than the second threshold pressure in response to a determination that the pressure within the receiving tank exceeds the second threshold pressure;

wherein after increasing the first threshold pressure to the first adjusted threshold pressure, the controller is configured to:

compare the pressure within the receiving tank to the first threshold pressure and the second threshold pressure; and close the gas bypass valve and control the pressure within the receiving tank using only the parallel compressor in response to a determination that the pressure within the receiving tank is between the second threshold pressure and the first threshold pressure.

2. The system of claim 1, wherein indication of the CO2 refrigerant flow rate comprises a measurement of at least one of a position of the gas bypass valve, a volumetric flow rate of the CO2 refrigerant through the gas bypass valve, or a mass flow rate of the CO2 refrigerant through the gas bypass valve.

3. The system of claim 1, wherein the controller is configured to deactivate the parallel compressor and reset the first threshold pressure in response to a determination that the pressure within the receiving tank is less than the second threshold pressure.

4. The system of claim 1, further comprising a pressure sensor configured to measure a pressure within the receiving tank and transmit a signal representing the pressure to the controller, wherein the controller is further configured to operate at least one of the gas bypass valve and the parallel compressor to control the pressure within the receiving tank based on the measured pressure.

5. The system of claim 1, further comprising a flow sensor configured to measure a flow through the gas bypass valve and transmit a signal representing the measurement of the flow to the controller.

6. The system of claim 5, wherein the flow sensor is positioned in a flow line coupled between the gas bypass valve and the receiving tank.

7. The system of claim 5, wherein the flow sensor is coupled to the gas bypass valve.

8. A method for controlling pressure in a CO2 refrigeration system having a receiving tank, a compressor, and a gas cooler/condenser, the method comprising:

receiving an indication of a CO2 refrigerant flow rate through a gas bypass valve fluidly connected with an outlet of the receiving tank and arranged in series with the compressor;

comparing the indication of the CO2 refrigerant flow rate with a threshold value indicating a threshold flow rate through the gas bypass valve; and activating a parallel compressor fluidly connected with the outlet of the receiving tank and arranged in parallel with both the gas bypass valve and the compressor in response to the indication of the CO2 refrigerant flow rate exceeding the threshold value;

increasing a first threshold pressure to a first adjusted threshold pressure higher than a second threshold pressure in response to a determination that the pressure within the receiving tank exceeds the second threshold pressure; and after increasing the first threshold pressure to the first adjusted threshold pressure:

comparing the pressure within the receiving tank to the first threshold pressure and the second threshold pressure; and closing the gas bypass valve and controlling the pressure within the receiving tank using only the parallel compressor in response to a determination that the pressure within the receiving tank is between the second threshold pressure and the first threshold pressure.

9. The method of claim 8, wherein receiving the indication of a CO2 refrigerant flow rate through a gas bypass valve comprising:

measuring at least one of a position of the gas bypass valve, a volume flow rate of the CO2 refrigerant through the gas bypass valve, or a mass flow rate of the CO2 refrigerant through the gas bypass valve; and transmitting a signal representing the measurement.

10. The method of claim 8, further comprising:

measuring a pressure within the receiving tank; and operating at least one of the gas bypass valve and the parallel compressor to control the pressure within the receiving tank based on the measured pressure.

11. The method of claim 8, further comprising:

measuring a flow through the gas bypass valve; and transmitting a signal representing the measurement of the flow.

12. The method of claim 11, wherein measuring a flow through the gas bypass valve comprises sensing the flow though a flow line coupling the gas bypass valve to the receiving tank.

13. A controller for controlling pressure in a CO2 refrigeration system having a receiving tank, a compressor, and a gas cooler/condenser, the controller configured to:

receive an indication of a CO2 refrigerant flow rate through a gas bypass valve fluidly connected with an outlet of the receiving tank and arranged in series with the compressor;

compare the indication of the CO2 refrigerant flow rate with a threshold value indicating a threshold flow rate through the gas bypass valve;

activate a parallel compressor fluidly connected with the outlet of the receiving tank and arranged in parallel with both the gas bypass valve and the compressor in response to the indication of the CO2 refrigerant flow rate exceeding the threshold value;

compare the pressure within the receiving tank to a first threshold pressure and a second threshold pressure higher than the first threshold pressure;

control the pressure within the receiving tank using the parallel compressor in response to a determination that the pressure within the receiving tank exceeds the second threshold pressure;

wherein after increasing the first threshold pressure to a first adjusted threshold pressure, the controller is configured to: compare the pressure within the receiving tank to the first threshold pressure and the second threshold pressure; and close the gas bypass valve and control the pressure within the receiving tank using only the parallel compressor in response to a determination that the pressure within the receiving tank is between the second threshold pressure and the first threshold pressure.

14. The controller of claim 13, wherein the indication of the CO2 refrigerant flow rate comprises at least one of a position of the gas bypass valve, a volume flow rate of the CO2 refrigerant through the gas bypass valve, or a mass flow rate of the CO2 refrigerant through the gas bypass valve.

15. The controller of claim 13, wherein the controller is further configured to increase the first threshold pressure to a first adjusted threshold pressure higher than the second threshold pressure in response to a determination that the pressure within the receiving tank exceeds the second threshold pressure.

16. The controller of claim 13, wherein the controller is further configured to receive a measured pressure from a pressure sensor coupled to the receiving tank; and operate at least one of the gas bypass valve and the parallel compressor to control the pressure within the receiving tank based on the measured pressure.

17. The controller of claim 13, wherein the controller is further configured to:

receive a measured flow from a flow sensor configured to measure the CO2 refrigerant flow rate through the gas bypass valve.

18. The controller of claim 17, wherein the flow sensor is positioned in a flow line coupled between the gas bypass valve and the receiving tank.

19. The controller of claim 17, wherein the flow sensor is coupled to the gas bypass valve.

20. The method of claim 8, further comprising:

determining that the pressure within the receiving tank is less than the second threshold pressure; and responsive to determining that the pressure within the receiving tank is less than the second threshold pressure, deactivating the parallel compressor and resetting the first threshold pressure.

21. The controller of claim 13, wherein the controller is configured to deactivate the parallel compressor and reset the first threshold pressure in response to a determination that the pressure within the receiving tank is less than the second threshold pressure.

* * * * *